US006469452B2

(12) United States Patent
Seo et al.

(10) Patent No.: US 6,469,452 B2
(45) Date of Patent: Oct. 22, 2002

(54) PLASMA DISPLAY PANEL AND ITS DRIVING METHOD

(75) Inventors: Yoshiho Seo; Yasunobu Hashimoto; Kenji Awamoto; Akihiro Otsuka, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/825,041

(22) Filed: Apr. 4, 2001

(65) Prior Publication Data

US 2002/0109463 A1 Aug. 15, 2002

(30) Foreign Application Priority Data

Nov. 30, 2000 (JP) ..... 2000-365656

(51) Int. Cl.[7] ..... G09G 3/10
(52) U.S. Cl. ..... 315/169.4; 345/206; 345/212
(58) Field of Search ..... 315/169.3, 169.4, 315/169.1; 345/204, 206, 211, 212, 214, 37, 60

(56) References Cited

U.S. PATENT DOCUMENTS 3,754,230 A * 8/1973 Auger ..... 315/171
6,087,779 A * 7/2000 Sakamoto et al. ..... 315/169.1
6,337,673 B1 * 1/2002 Ide et al. ..... 345/208

* cited by examiner

*Primary Examiner*—Don Wong
*Assistant Examiner*—Thuy Vinh Tran
(74) *Attorney, Agent, or Firm*—Staas & Halsey LLP

(57) ABSTRACT

A plasma display panel includes at least one pair of discharge electrodes disposed on a substrate, a drive circuit for applying a discharge voltage to the discharge electrodes, capacity elements for raising voltage connected in series between the discharge electrodes and the drive circuit, and a control circuit for generating discharge across the discharge electrodes. The control circuit applies a charging voltage to the capacity elements for raising voltage and thereafter applies the discharge voltage from the drive circuit to the discharge electrodes via the capacity elements for raising voltage.

7 Claims, 21 Drawing Sheets

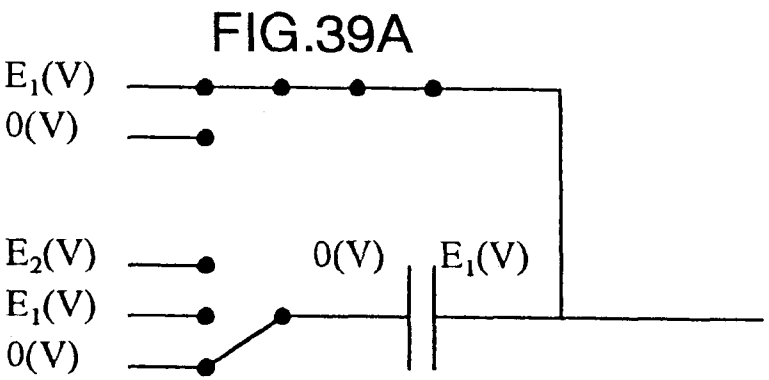
FIG.39A
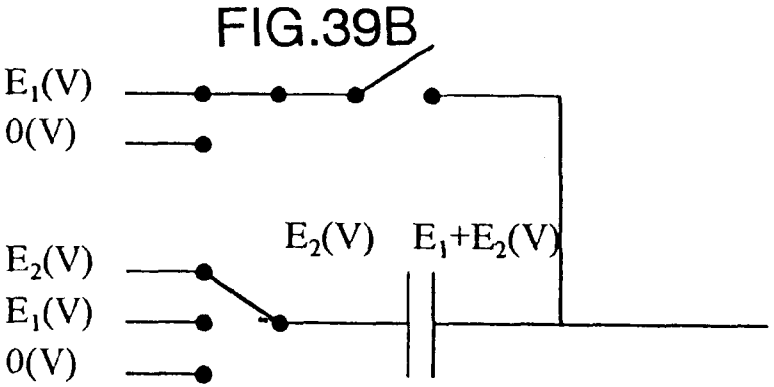
FIG.39B
FIG.39C
FIG.39D

PRIOR ART

PLASMA DISPLAY PANEL AND ITS DRIVING METHOD

CROSS-REFERENCE TO RELATED APPLICATION

This application is related to Japanese Patent Application No. 2000-365656 filed on Nov. 30, 2000, whose priority is claimed under 35 USC §119, the disclosure of which is incorporated by reference in its entirety.

BACKGROUND OF THE INVENTION

1. Field of the Invention

The present invention relates to a plasma display panel (PDP) and its driving method.

2. Description of Related Art

PDPs are display panels in which a pair of substrates formed with discharge electrodes thereon is disposed in an opposed relation and is sealed at the periphery to form a discharge space inside. The PDPs need a relatively high drive voltage for generating discharge. For this reason, they require a drive circuit (driver) with a high voltage resistance and a high capacity, and consequently, its production costs are high. Also, power consumption is large.

To cope with such problems, various countermeasures have been proposed. However, in the PDPs, the drive voltage cannot be decreased greatly because it is determined by discharge which is a physical phenomenon.

In the PDPs, the power consumption is the sum of power consumption required for charging inter-electrode capacity, power consumption required for discharge, and power consumption required by the drive circuit.

Among them, the power consumption required for charging the inter-electrode capacity is referred to as reactive power. A power collecting technique allows this power to be re-used to some extent for the purpose of reducing the power consumption. The power consumption required by the drive circuit is determined by the drive voltage. The power consumption required for discharge is represented by the drive voltage multiplied by electric current flowing into the discharge space by discharge. This is explained by taking an AC-driven PDP for example. First, a panel structure of the AC-driven PDP is described.

FIG. 44 is a perspective view partially illustrating the structure of a typical AC-driven three-electrode surface-discharge PDP. As shown in this figure, a PDP 10 is composed of a front panel assembly including a front substrate 11 and a rear panel assembly including a rear substrate 21. The front substrate 11 and the rear substrate 21 are formed of glass.

Electrodes X and Y formed on an inside surface of the front substrate 11 are for generating a surface discharge for display between a pair of electrodes X and Y. The electrodes X and Y are each formed of a wide transparent electrode 12 of ITO, $SnO_2$ or the like and a narrow bus electrode 13 for reducing the resistance of the electrode. The bus electrode 13 is formed of a metal such as Ag, Au, Al, Cu, Cr, their laminate (e.g. a laminate of Cr/Cu/Cr) or the like. The electrodes X and Y are formed in a desired number to a desired thickness and width at desired intervals by utilizing a printing method for Ag and Au and by combining a film forming method such as vapor deposition, sputtering or the like with an etching method for other materials. Either the electrodes X or Y are used as scan electrodes.

A dielectric layer 17 is formed by applying a glass paste containing a low-melting glass frit, a binder and a solvent onto the front substrate 11 by a screen printing method, followed by burning.

On the dielectric layer 17, a protective film 18 is mounted for protecting the dielectric layer 17 from damage owing to impact of ions generated by discharge at display operation. The protective film 18 is formed of MgO, CaO, SrO, BaO or the like, for example.

Address electrodes A are formed on an inside surface of the rear substrate 21 so as to cross the electrodes X and Y. The address electrodes A are for generating an address discharge where the address electrodes cross the scanning electrodes X or Y. The address electrodes A are formed of Ag, Au, Al, Cu, Cr, their laminate (e.g. a laminate of Cr/Cu/Cr) or the like, for example. The address electrodes A, like the electrodes X and Y, are formed in a desired number to a desired thickness and width at desired intervals by utilizing the printing method for Ag and Au and by combining a film forming method such as vapor deposition, sputtering or the like with the etching method for other materials.

A dielectric layer 24 is formed of the same material by the same method as the dielectric layer 17.

Barrier ribs 29 can be formed on the dielectric layer 24 between the address electrodes by a sandblasting method, a printing method, a photo-etching method or the like. For example, they may be formed by applying a glass paste containing a low-melting glass frit, a binder, a solvent and the like onto the dielectric layer 24, drying it, cutting it by the sandblasting method and burning. Alternatively, the barrier ribs 29 can be formed with use of a photo-conductive resin as the binder, which is exposed using a mask and developed, followed by burning.

Fluorescent layers 28R, 28G and 28B can be formed by applying a phosphor paste containing a phosphor powder and a binder into grooves between the barrier ribs 29 by use of a screen printing method or a dispenser repeatedly for every color, followed by burning. Also, these fluorescent layers 28R, 28G and 28B can be formed with use of sheet-form materials (so-called green sheets) for the fluorescent layers containing phosphor powders and a binder by a photolithographic method. In this case, a sheet of a desired color is attached over a display area on the substrate, exposed and developed. This process is repeated for every color, thereby forming the fluorescent layers of the respective colors in corresponding grooves between the barrier ribs.

The PDP 10 is produced by placing the above-described front and rear panel assemblies in the opposed relation so that the electrodes X and Y are orthogonal to the address electrodes, sealing the periphery and feeding a discharge gas of neon, xenon and the like into spaces surrounded by the barrier ribs 29. In this PDP 10, a discharge space at the crossing of one pair of electrodes X and Y and one address electrode is one cell region (unit light-emitting region) which is the minimum unit of display.

In this AC-driven PDP 10, a discharge phenomenon across electrodes terminates spontaneously as a cell voltage (voltage applied to the discharge space) declines by the formation of a wall charge (an electric charge formed on a surface of the dielectric layer facing the discharge space). The amount of the wall charge formed at this time is an amount such that the cell voltage becomes a "0." That is, with regard to the discharge across the electrodes X and Y, if +E (V) and 0 (V) are applied to the electrodes X and Y, respectively, the wall charge is so formed to have a potential of +E/2 (V) on the surface of the dielectric layer on the electrode.

If a capacity of C (F) is formed between the electrode and the surface of the dielectric layer on the electrode, a charge Qx=CE/2 (C) is formed on the surface of the dielectric layer above the electrode X and a charge Qy=−CE/2 (C) is formed on the surface of the dielectric layer above the electrode Y. Accordingly, if a drive frequency is f, a discharge current I can be represented by $I=CE^2f$ because the period of discharge is 2f. A power consumption P is $P=CE^2f$ because P=voltage×current. As understood from the above, a reduction in the voltage E and a reduction in the capacity C are necessary for reducing the power consumption at the discharge.

As measures to reduce the capacity C, the area of electrodes can be decreased, the thickness of the dielectric layer can be increased, the dielectric constant of the dielectric layer can be decreased and the like. However, a decrease in the area of electrodes and an increase in the thickness of the dielectric layer result in a rise in the drive voltage. As regards a decrease in the dielectric constant of the dielectric layer, it is necessary to develop a new dielectric having a low dielectric constant. Therefore, in order to reduce the power consumption at the discharge, the drive voltage needs to be decreased without a decrease in an electrode voltage.

SUMMARY OF THE INVENTION

The present invention has been made in view of the above-mentioned circumstances, and an object thereof is to provide a plasma display panel and its driving method by inserting a capacity element for raising voltage between electrodes and a drive circuit, and utilizing a charge stored in the capacity element for obtaining a high electrode voltage with a low drive voltage, thereby reducing the power consumption.

The present invention provides a plasma display panel comprising at least one pair of discharge electrodes disposed on a substrate; a drive circuit for applying a discharge voltage for generating discharge to the discharge electrodes; capacity elements for raising voltage connected in series between the discharge electrodes and the drive circuit; and a control circuit for generating the discharge across the discharge electrodes, the control circuit applying a charging voltage to the capacity elements for raising voltage and thereafter applying the discharge voltage from the drive circuit to the discharge electrodes via the capacity elements or raising voltage.

According to the present invention, when the discharge is generated across the discharge electrodes, voltage by the charge stored in the capacity element for raising voltage is added to the discharge voltage applied from the drive circuit. This voltage in total is applied to the discharge electrodes. Thus, the discharge can be produced by lower drive voltage than in a PDP without the capacity elements for raising voltage. Thereby, a load on the drive circuit, the power consumption and costs of the drive circuit can be reduced.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIGS. 39A to 39D illustrate a driving method in accordance with the present invention in which the voltage of a switch element of the drive circuit is reduced;

DESCRIPTION OF THE PREFERRED EMBODIMENTS

Figure 1:
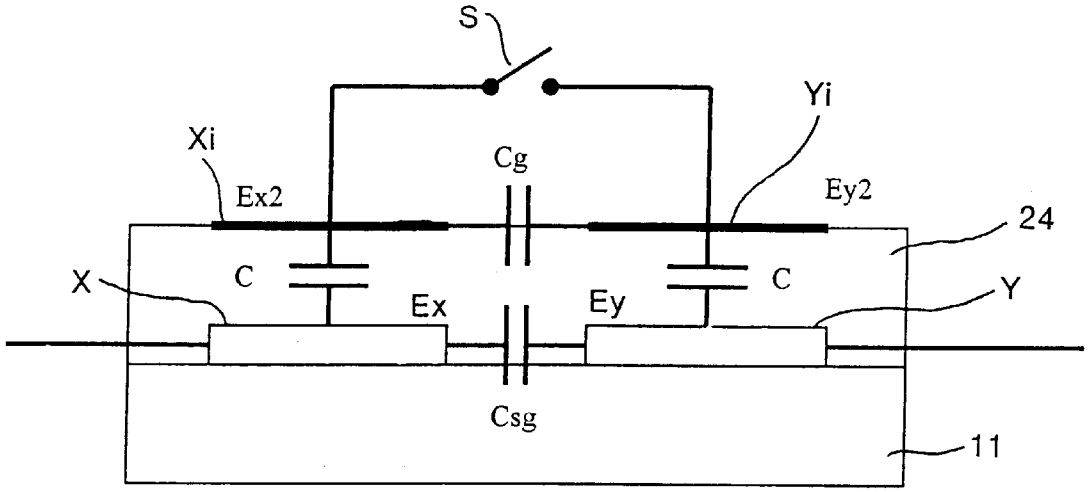
FIG.1 (PRIOR ART)
FIG. 1 shows an equivalent circuit of a conventionally typical PDP.

In the present invention, the substrate may be a substrate of glass, quartz, ceramic or the like which may optionally include one or more desired components such as electrodes, an insulating film, a dielectric film, a protective film and/or the like formed thereon.

The discharge electrodes may be formed of any electrode material by any formation method known in the art similarly to display electrodes (i.e., sustain electrodes) and address electrodes of PDPs, without any particular limitation. As such electrode materials, transparent electrode materials and metal electrode materials may be mentioned. Examples of transparent electrode materials include ITO, $SnO_2$, ZnO and the like and examples of metal electrode materials include Ag, Au, Al, Cu, Cr, their alloys, their laminates (e.g., a laminate of Cr/Cu/Cr, etc.) and the like. The discharge electrodes may be formed in a desired number to a desired thickness and width at desired intervals using the printing method for Ag and Au and using a combination of a film forming method such as vapor deposition, sputtering or the like with the etching method for other materials.

The drive circuit applies the discharge voltage across the discharge electrodes and may be composed of a driver or the like known in the art.

The capacity elements for raising voltage are connected in series between the discharge electrodes and the drive circuit. Various kinds of condensers used in ordinary electric circuits are usable. In the case where drive electrodes are further mounted with intervention of a dielectric layer between the drive electrodes and the discharge electrodes, the voltage-raising capacity elements may also be formed of the dielectric layer intervening between the drive electrodes and the discharge electrodes.

For generating the discharge across the discharge electrodes, the control circuit can conduct a control such that, after a charging voltage is applied to the voltage-raising capacity elements, the discharge voltage is applied to the discharge electrodes from the drive circuit via the voltage-raising capacity elements. The control circuit may be composed of a gate circuit, a microcomputer or the like known in the art, for example.

In another aspect, the present invention provides a drive method for the above-described plasma display panel including a panel in which a great number of cells are arranged in matrix between a pair of substrates, the cells each having a pair of drive electrodes and a pair of discharge electrodes, the method comprising applying a scan pulse to the cells in the panel to select a cell to be lit and thereafter applying the same sustain pulse to all the cells to sustain the lighting of the selected cell, wherein, both at application of the scan pulse and at application of the drive pulse, the charging voltage is applied to the voltage-raising capacity elements and thereafter the discharge voltage is applied from the drive circuit to the discharge electrodes via the voltage-raising capacity elements, for generating discharge across the discharge electrodes in each cell.

The invention is now described in further detail by way of examples with reference to the accompanying drawings. However, the examples should not be construed to limit the scope of the invention.

The present invention can apply to any AC-driven PDP in which electrodes are covered with a dielectric layer whatever structure the PDP has. However, since the invention can be suitably applied to an AC-driven three-electrode surface-discharge PDP as shown in FIG. 44, the invention is now explained with a PDP of this structure.

Figure 44:
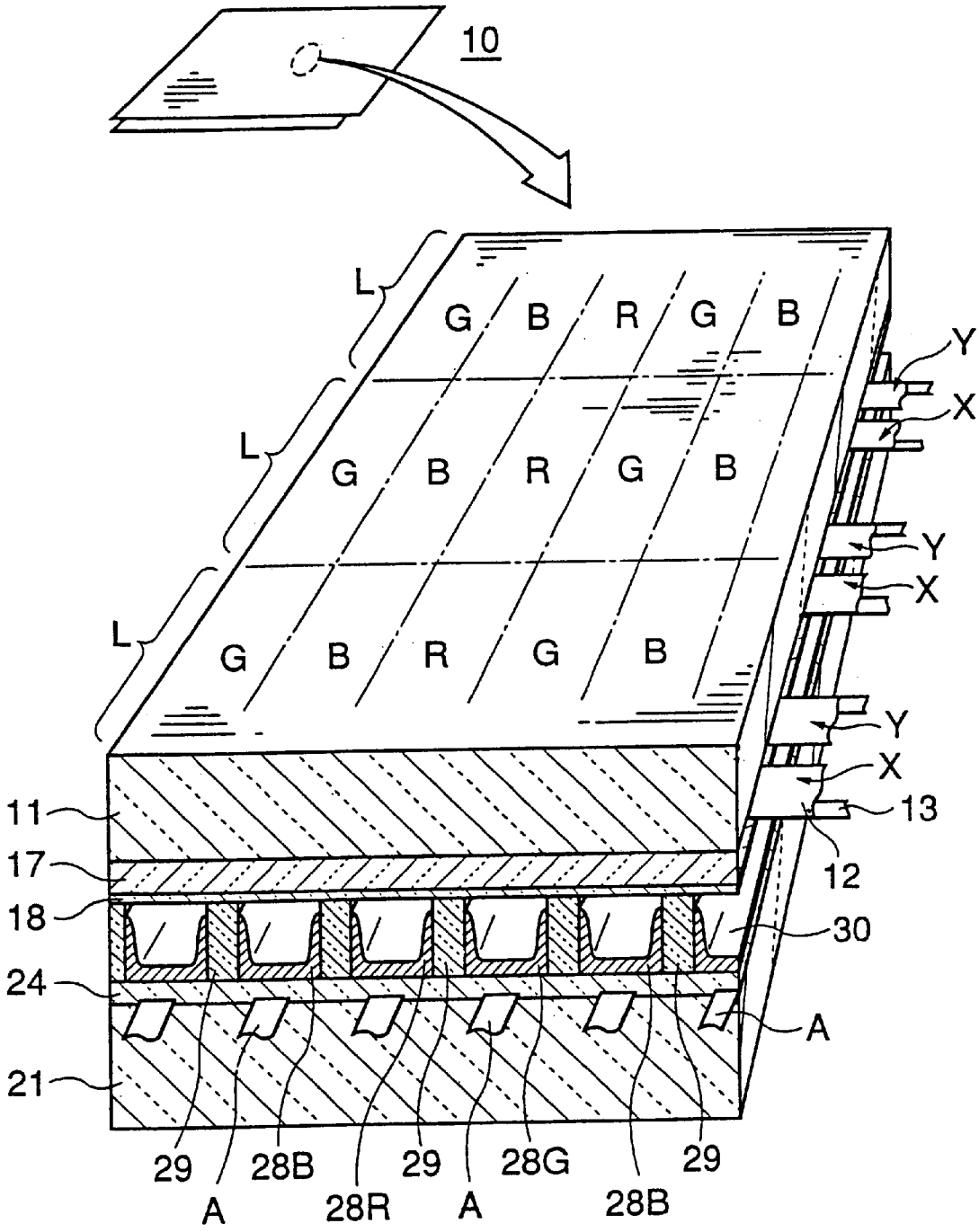
FIG. 44 is a perspective view of a part of a conventionally typical AC-drive PDP of three-electrode surface-discharge type.

FIG. 1 illustrates an equivalent circuit of a typical PDP, showing enlargement of an X electrode and a Y electrode of the AC-driven three-electrode surface-discharge PDP shown in FIG. 44.

In the figure, Xi denotes a virtual electrode on the surface of a dielectric layer 24 above the X electrode, and Yi denotes a virtual electrode on the surface of the dielectric layer 24 above the Y electrode. A virtual switch S1 shorts when discharge occurs across the Xi and Yi electrodes. Ex represents the voltage of the X electrode, Ey represents the voltage of the Y electrode, Ex2 represents the voltage of the Xi electrode, and Ey2 represents the voltage of the Yi electrode.

C represents a capacity formed between the X electrode and the Xi electrode or between the Y electrode and the Yi electrode, Csg represents a capacity between X and Y electrodes, and Cg represents a capacity between Xi and Yi electrodes. These capacities have a relationship of C>Csg>>Cg.

Figure 2:
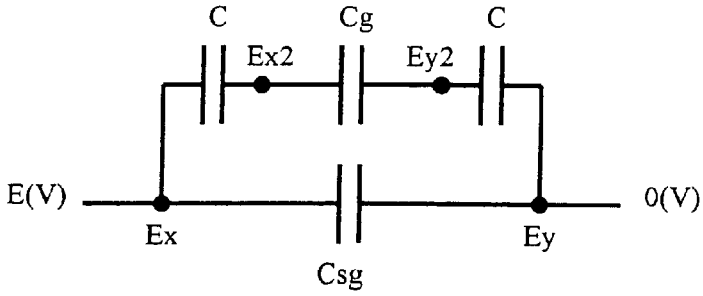
FIG.2 (PRIOR ART)
FIG. 2 shows an equivalent circuit of the conventionally typical PDP before discharge.

Here, if +E (V) and 0 (V) are applied to the X electrode and the Y electrode, respectively, the equivalent circuit before discharge is shown in FIG. 2. Since the capacity Cg is smaller than th e other capacities, a charge Q=Csg·is stored between the X and Y electrodes.

Figure 3:
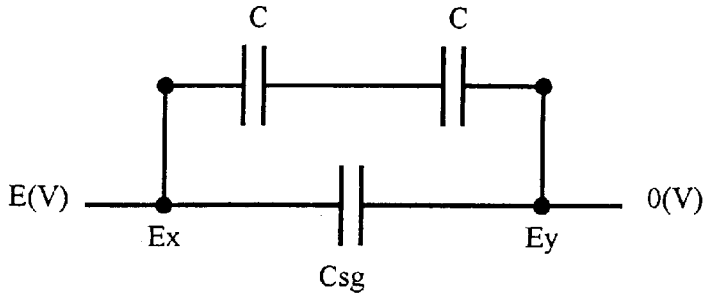
FIG.3 (PRIOR ART)
FIG. 3 shows an equivalent circuit of the conventionally typical PDP during discharge.

When discharge occurs, a switch S in FIG. 1 is turned ON, the equivalent circuit is shown in FIG. 3. A charge Q=(C/

2+Csg) E is stored between the X and Y electrodes. Therefore, the quantity of the charge flowing by the discharge is Qd=CE/2.

Figure 4:
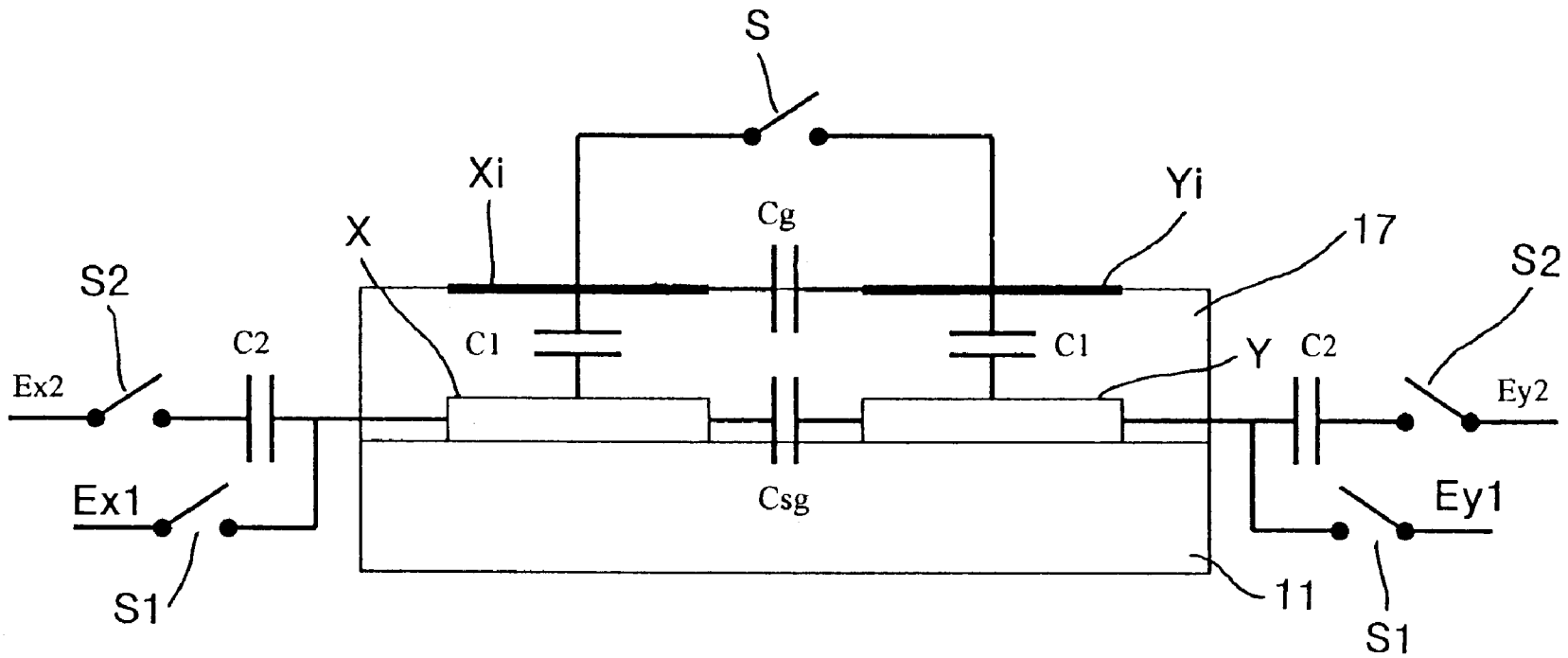
FIG. 4 shows an equivalent circuit of a PDP in accordance with the present invention.

FIG. 4 shows an equivalent circuit of a PDP in accordance with the present invention. The PDP of the present invention has the construction of the PDP shown in FIG. 1 plus voltage-raising capacity elements.

Here, a capacity $C_1$ corresponds to the capacity C in FIG. 1, and capacities Csg and Cg are the same as in FIG. 1. The capacity Cg is negligible enough as compared with the other capacities.

In the PDP of the present invention, the voltage-raising capacity elements are added as mentioned above. The capacity of the voltage-raising capacity element (voltage-raising capacity) is represented by $C_2$ in the figure. A switch S1 is for changing the voltage-raising capacity and a switch S2 is for applying a drive voltage.

In this PDP, in the first step for applying voltage to the X and Y electrodes, the switches S1 for changing the voltage-raising capacities and the switches S2 for applying the drive voltage are shorted to apply voltages Ex1–Ex'2 and Ey1–Ey'2 to the voltage-raising capacities $C_2$, connected in series to the X and Y electrodes, respectively, so that the voltage-raising capacities $C_2$ are charged.

Then, in the second step, the switches S1 for changing the voltage-raising capacities are opened and the switches S2 for applying the drive voltage are shorted, and simultaneously, a voltage Ex2 (with a value different from that of Ex'2) and Ey2 (with a value different from that of Ey'2) are applied to the X and Y electrodes, respectively, to generate discharge across the Xi and Yi electrodes.

Figure 5:
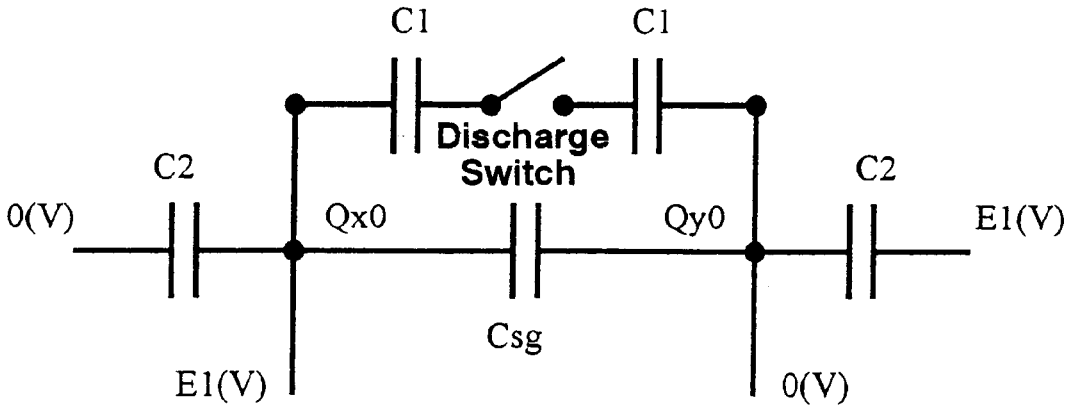
FIG. 5 shows an equivalent circuit of the PDP of the present invention while charging a voltage-raising capacity.

FIG. 5 shows an equivalent circuit while the voltage-raising capacities $C_2$ are being charged. At this time, a charge Qx0=$C_2$·E1+Csg·E1 is stored in the X electrode and a charge Qy0=−Qx0 is stored in the Y electrode.

Figure 6:
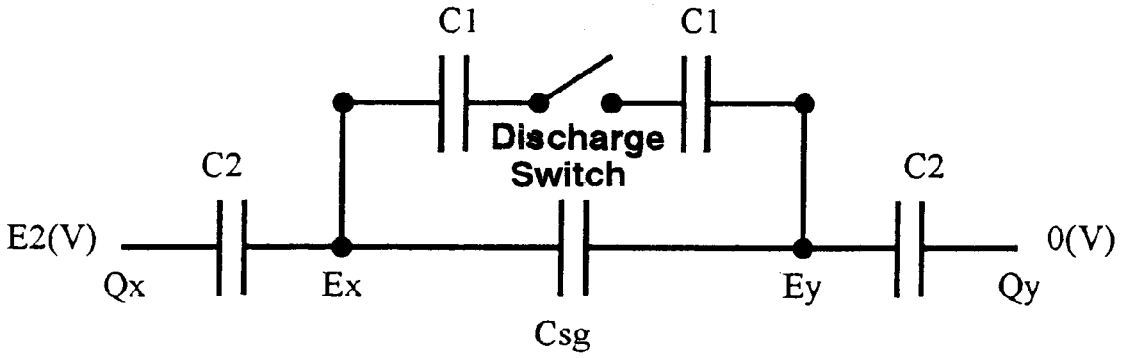
FIG. 6 shows an equivalent circuit of the PDP of the present invention in a discharge process.

FIG. 6 shows an equivalent circuit in a state in which the X and Y electrodes are floated and the voltage applied to the voltage-raising capacities $C_2$ is reversed. The floating of the X and Y electrodes means the state of the above-described second step. At this time, the potential Ex of the X electrode and the potential Ey of the Y electrode are represented by:

$$Ex = \left(\frac{C_2}{C_2 + 2Csg} + 1\right)\frac{E_1 + E_2}{2}$$

$$Ey = -\left(\frac{C_2}{C_2 + 2Csg}\frac{E_1 + E_2}{2} + \frac{E_1 - E_2}{2}\right)$$

At this time, charges (Qx and Qy in the figure) stored in voltage-applied portions are $$Qx = -C_2\left(\frac{C_2}{C_2 + 2Csg}\frac{E_1 + E_2}{2} + \frac{E_1 - E_2}{2}\right)$$

$$Qy = C_2\left(\frac{C_2}{C_2 + 2Csg}\frac{E_1 + E_2}{2} + \frac{E_1 - E_2}{2}\right)$$

Figure 7:
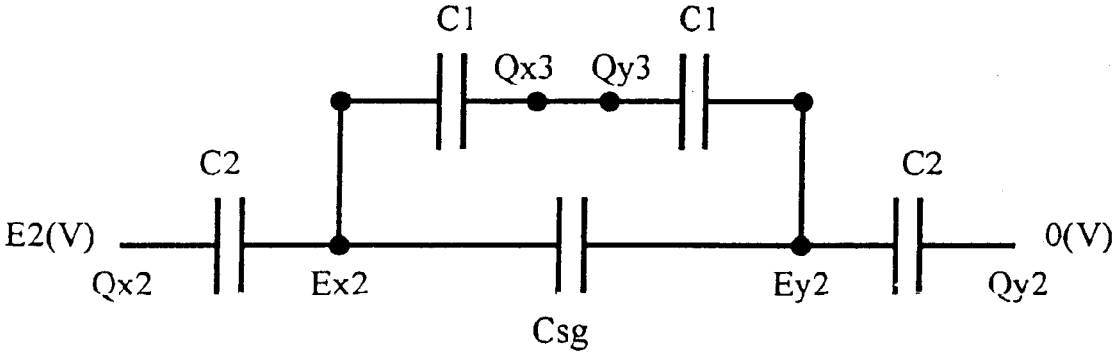
FIG. 7 shows an equivalent circuit of the PDP of the present invention at discharge.

FIG. 7 shows an equivalent circuit while discharge is taking place. At this time, the voltages Ex2 and Ey2 of the X and Y electrodes are:

$$Ex2 = \frac{C_2}{C_1 + C_2 + 2Csg} - \frac{E_1 + E_2}{2} + \frac{E_1 + E_2}{2}$$

-continued $$Ey2 = -\left(\frac{C_2}{C_1 + C_2 + 2Csg}\frac{E_1 + E_2}{2} + \frac{E_1 - E_2}{2}\right)$$

At this time, charges (Qx2 and Qy2 in the figure) stored in the voltage-applied portions are:

$$Qx2 = -C_2\left(\frac{C_2}{C_1 + C_2 + 2Csg}\frac{E_1 + E_2}{2} + \frac{E_1 - E_2}{2}\right)$$

$$Qy2 = C_2\left(\frac{C_2}{C_1 + C_2 + 2Csg}\frac{E_1 + E_2}{2} + \frac{E_1 - E_2}{2}\right)$$

The discharge changes the voltage of the electrodes by:

$$\Delta Ex = -\frac{C_1C_2}{(C_1 + C_2 + 2Csg)(C_2 + 2Csg)}\frac{E_1 + E_2}{2}$$

$$\Delta Ey = -\frac{C_1C_2}{(C_1 + C_2 + 2Csg)(C_2 + 2Csg)}\frac{E_1 + E_2}{2}$$

The charges in the voltage-applied portions are changed by:

$$\Delta Qx = C_2\frac{C_1C_2}{(C_1 + C_2 + 2Csg)(C_2 + 2Csg)}\frac{E_1 + E_2}{2}$$

$$\Delta Qy = -C_2\frac{C_1C_2}{(C_1 + C_2 + 2Csg)(C_2 + 2Csg)}\frac{E_1 + E_2}{2}$$

These are the quantity of current flowing by the discharge.

Further, charges formed on the surface of the dielectric layer 24 are:

$$Qx3 = -\frac{C_1C_2}{C_1 + C_2 + 2Csg}\frac{(E_1 + E_2)}{2} - \frac{C_1}{2}E_1$$

$$Qy3 = \frac{C_1C_2}{C_1 + C_2 + 2Csg}\frac{(E_1 + E_2)}{2} + \frac{C_1}{2}E_1$$

For simplicity of explanation, if Csg is small enough as compared with $C_1$ and $C_2$, voltages Ex=E1+E2 and Ey=−E1 are generated at the X and Y electrodes, respectively, when the electrodes are floated and the applied voltages are reversed after the voltage-raising capacities are charged. If this potential difference (2×E1+E2) is a discharge initiating voltage or higher, the discharge starts. For example, if E1=E2, the discharge takes place at E1=Vf⅓. The charge flowing by the discharge is:

$$\Delta Q = \frac{C_1C_2}{C_1 + C_2}\frac{E_1 + E_2}{2}$$

Thus, the insertion of the voltage-raising capacities $C_2$ reduces an apparent capacity. Since the applied voltage is E2, power consumed by one occurrence of discharge is:

$$P = \Delta Q \cdot E_2 = \frac{C_1C_2}{C_1 + C_2}\frac{E_1 + E_2}{2}E_2$$

If E1=E2 as described above, the drive voltage may be reduced to ⅓. Accordingly, E1=E2=E/3 is possible, and the following is obtained:

$$P = \Delta Q \cdot E_2 = \frac{C_1 C_2}{C_1 + C_2} \frac{1}{9} E^2$$

Further, the energy stored in the voltage-raising capacities $C_2$ is decreased by the discharge by:

$$\Delta Px = \Delta Py = Q_{x0} \cdot \Delta Ex = -C_2 E_1 \frac{C_1}{(C_1 + C_2)} \frac{E_1 + E_2}{2}$$

If E1=E2 as described above, the total power consumed by one occurrence of discharge is:

$$P = \Delta Q \cdot E_2 = \frac{C_2}{C_1 + C_2} \frac{1}{3} C_1 E^2$$

From this, it is understood that the power consumption can be reduced to one-third of that conventionally consumed if the voltage-raising capacity $C_2$ is large and can be reduced more effectively if the voltage-raising capacitance $C_2$ is further reduced.

A wall voltage:

$$Vw = \frac{C_2}{C_1 + C_2}(E_1 + E_2) + E_1$$

is formed. Thus, if the voltage-raising capacity $C_2$ is large enough, a wall voltage equal to an applied effective voltage is formed.

Example 1

The above-described voltage-raising capacity $C_2$ may be provided on a circuit board for a driver (driving circuit) of the PDP or on a glass substrate of the PDP.

Figure 8:
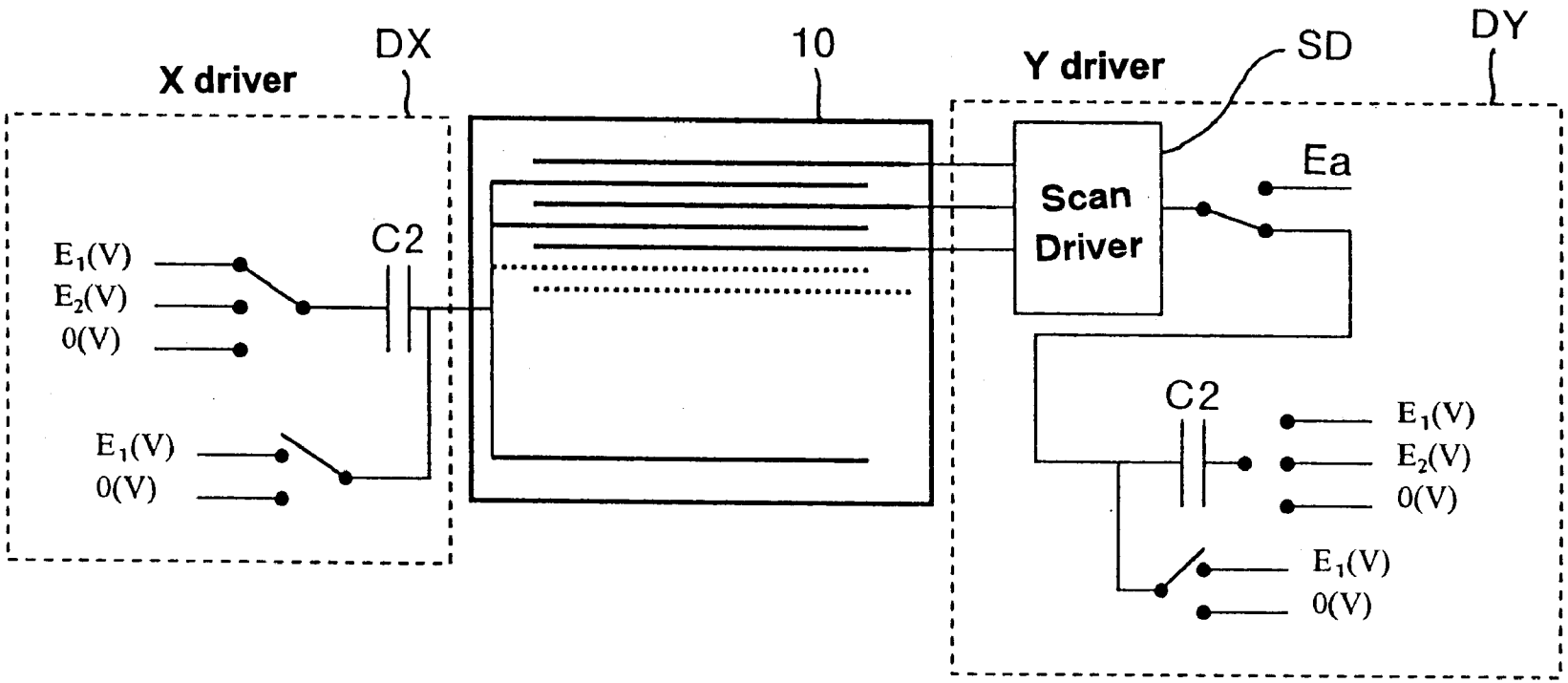
FIG. 8 is a diagram illustrating a PDP in accordance with Example 1 of the present invention.

FIG. 8 is a diagram illustrating a PDP in accordance with Example 1, in which the voltage-raising capacity $C_2$ is provided on the circuit board for the driver. In this example, the voltage-raising capacity $C_2$ is utilized only in a display period.

In this figure, there are shown an X electrodes driver DX, a Y electrodes driver DY and a scan driver SD provided in the Y electrodes driver DY, and Ea denotes an address voltage.

Generally, the AC-driven three-electrode surface-discharge PDP shown in FIG. 44 performs display by a gradation drive system referred to as an address-display separation sub-field method. In this gradation driving system, one frame (one field if one frame is comprised of a plurality of fields) is divided, for example, into eight sub-fields (SFs) with weighted luminance. Each sub-field includes an address period and a display (sustain) period. In the address period, cells to be lit in the present sub-field are selected, and in the display period, the lighting of the selected cells is sustained. For this purpose, in the address period, a scan pulse is applied sequentially to Y electrodes while an address pulse is applied to desired address electrodes. Thereby, an address discharge is generated in the cells to be lit so as to form a wall charge in the cells. In the sustain period, the lighting of the cells in which the wall charge has been formed is sustained by applying a voltage alternately to the X electrode and the Y electrode. In this example, the voltage-raising capacity $C_2$ is utilized only in the display period in the above-described gradation driving system.

In this case, an address voltage Ea is applied in the address period in which the conventional driving method is conducted. The voltage-raising capacity $C_2$ is utilized only in the display period. The scan driver SD is used for scanning in the address period but is used for applying a voltage simultaneously to all the Y electrodes in the display period.

EXAMPLE 2

Figure 9:
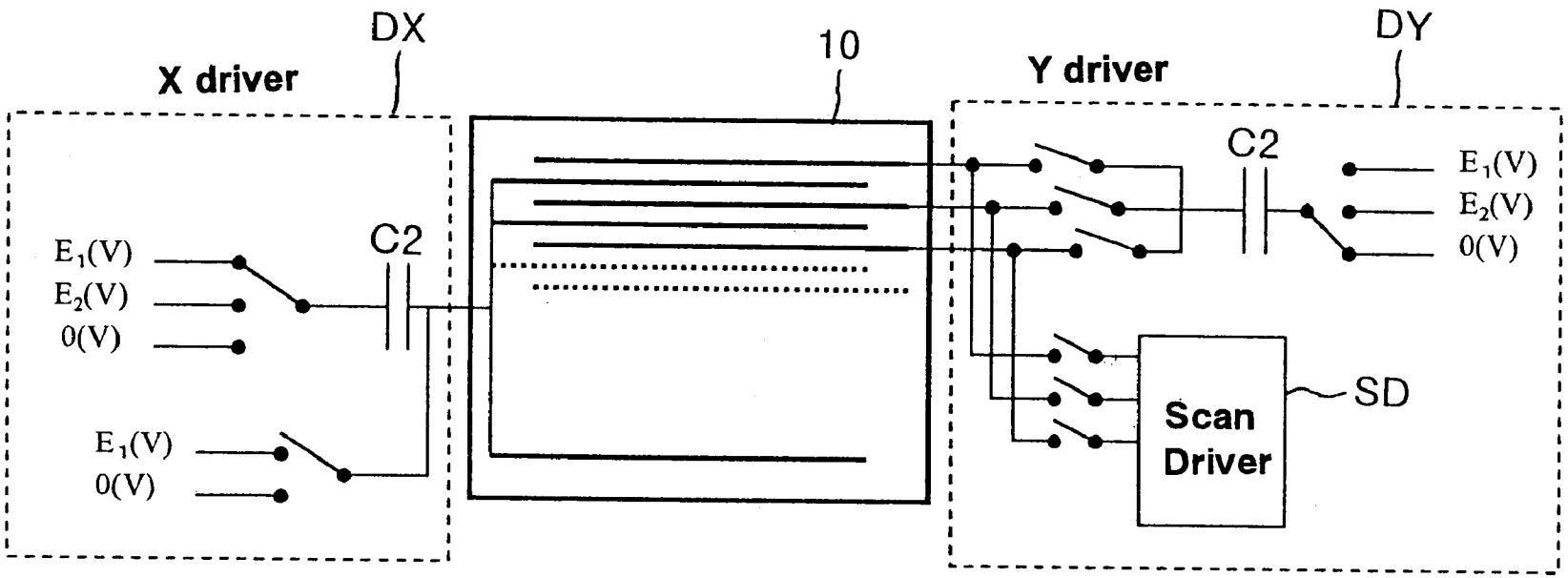
FIG. 9 is a diagram illustrating a PDP in accordance with Example 2 of the present invention.

FIG. 9 is a diagram illustrating a PDP in accordance with Example 2, in which the voltage-raising capacity $C_2$ is provided on the circuit board for the driver and is utilized only in the display period, as in Example 1. However, in this example, the scan driver SD is used for charging the voltage-raising capacity $C_2$.

The scan driver SD is used for scanning in the address period, and is used for charging the voltage-raising capacity $C_2$ via lead lines of the Y electrodes in the display period.

EXAMPLE 3

Figure 10:
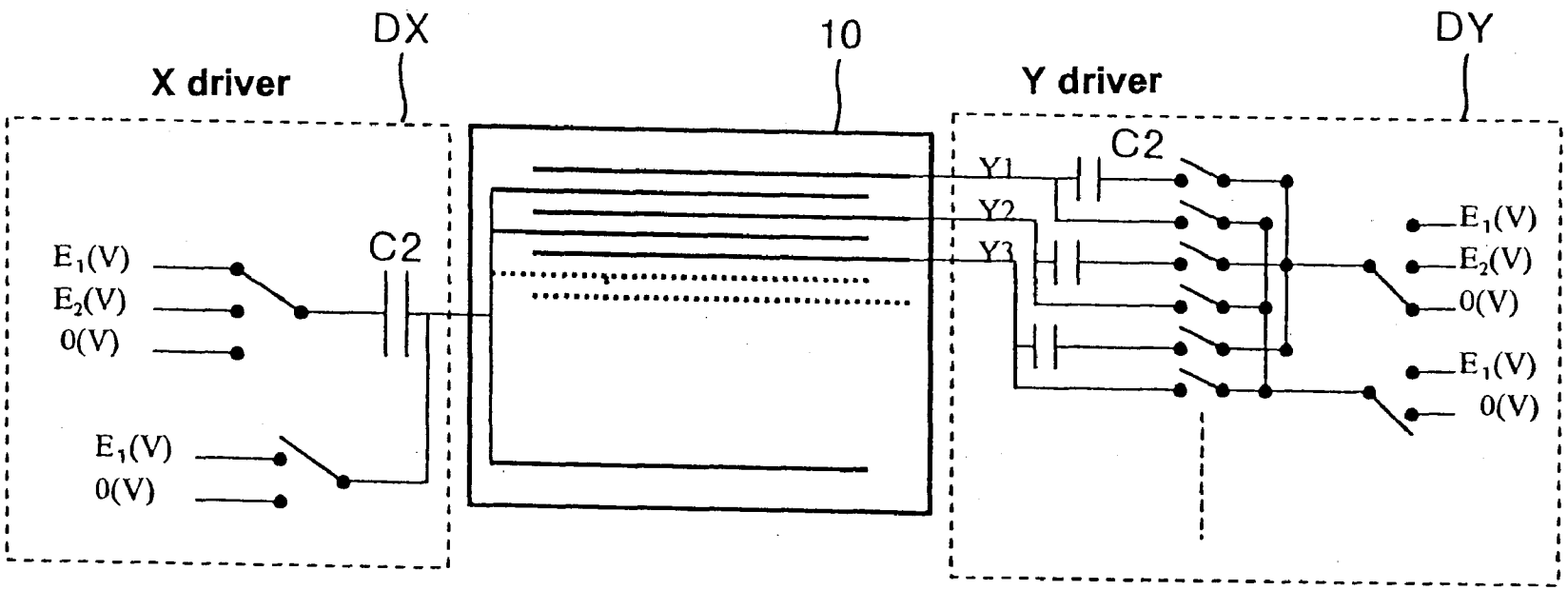
FIG. 10 is a diagram illustrating a PDP in accordance with Example 3 of the present invention.

FIG. 10 is a diagram illustrating a PDP in accordance with Example 3, in which the voltage-raising capacity $C_2$ is also provided on the circuit board for the driver as in Example 1.

However, the voltage-raising capacity $C_2$ is utilized in the address period and in the display period in this example and is formed in a line driver.

In the address period, each line of the Y electrodes has an independent potential. That is, since each line has the voltage-raising capacity $C_2$, the voltage-raising capacity $C_2$ may be smaller than that in Examples 1 and 2.

The voltage-raising capacity $C_2$ in the scan driver may be charged before a voltage is applied to each line, may be charged simultaneously in all the lines at the beginning of the address period, or maybe charged block by block if the lines are divided into several blocks.

Figure 11:
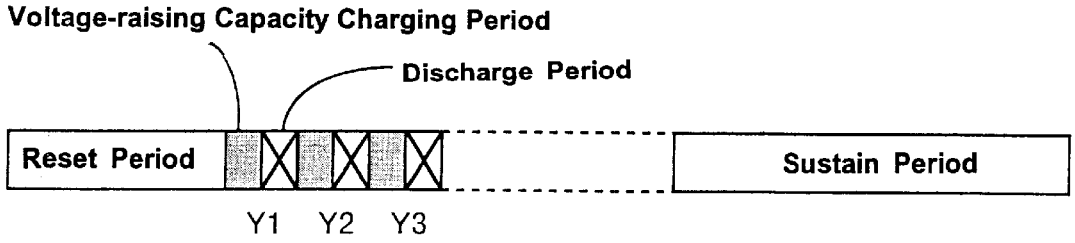
FIG. 11 illustrates an example of a drive method in accordance with Example 3 of the present invention.

FIG. 11 illustrates an example of a drive method in accordance with Example 3, showing the details of one sub-field in the case where the voltage-raising capacity is charged before a voltage is applied to each line.

As described above, in the gradation drive method, one sub-field has the address period and the display period. Typically, a reset period is set before the address period, during which all cells are cleared of charges.

In this drive method, in the address period after the reset period, the voltage-raising capacity $C_2$ is charged in each line and thereafter the scan pulse is applied. Although explanation is omitted, the voltage-raising capacity $C_2$ may or may not be utilized in the reset period and the display period. In this case, there are advantages that the voltage-raising capacity $C_2$ can be charged in a shorter time because the voltage-raising capacity in each line is small and also that the leakage of charges is less likely to occur because a discharge process comes immediately after a voltage-raising process.

Figure 12:
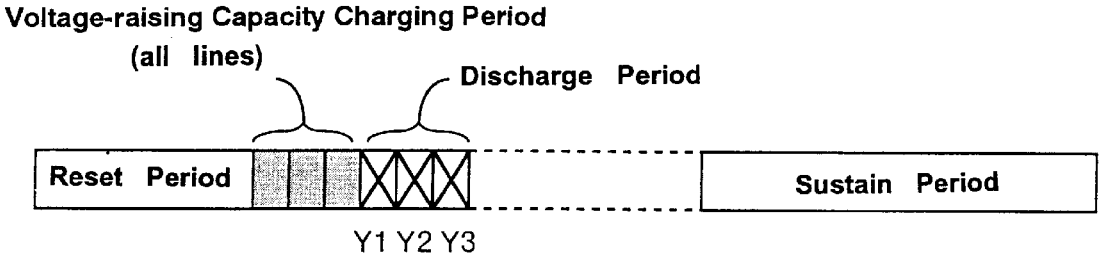
FIG. 12 illustrates an example of a drive method in accordance with Example 3 of the present invention.

FIG. 12 illustrates another example of a drive method in accordance with Example 3, showing the details of one sub-field in the case where the voltage-raising capacity $C_2$ is charged simultaneously in all the lines at the beginning of the address period.

In this drive method, in the address period after the reset period, the voltage-raising capacity $C_2$ is charged simultaneously in all the lines at first and then the scan pulse is applied to each line. In the reset period and the display period, the voltage-raising capacity $C_2$ may or may not be utilized. This method is advantageous where the number of scan lines are large because the charging of the voltage-raising capacity $C_2$ is completed at once. There is also an advantage that reactive power can be reduced because the number of chargings and dischargings of reactive capacity is decreased.

In the case where the scan lines are divided into several blocks and the voltage-raising capacity is charged on a block basis, settings may be determined so as to take advantages of both the above-mentioned methods.

EXAMPLE 4

Figure 13:
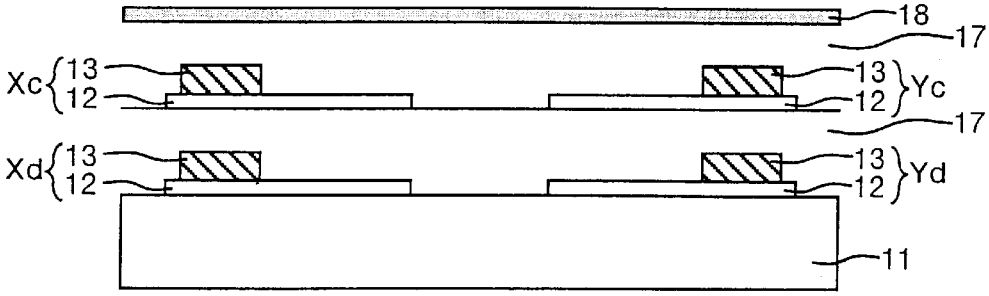
FIG. 13 is a schematic view illustrating a PDP in accordance with Example 4 of the present invention.

FIG. 13 is a schematic view illustrating a PDP in accordance with Example 4. The voltage-raising capacity $C_2$ is provided on a front glass substrate of the PDP.

In this example, a dielectric layer 17 is formed on drive electrodes (Xd and Yd electrodes) on a front glass substrate 11. Further, on the dielectric layer 17, discharge electrodes (Xc and Yc electrodes) are formed. Another dielectric layer 17 and a protecting layer 18 are formed on them.

Figure 14:
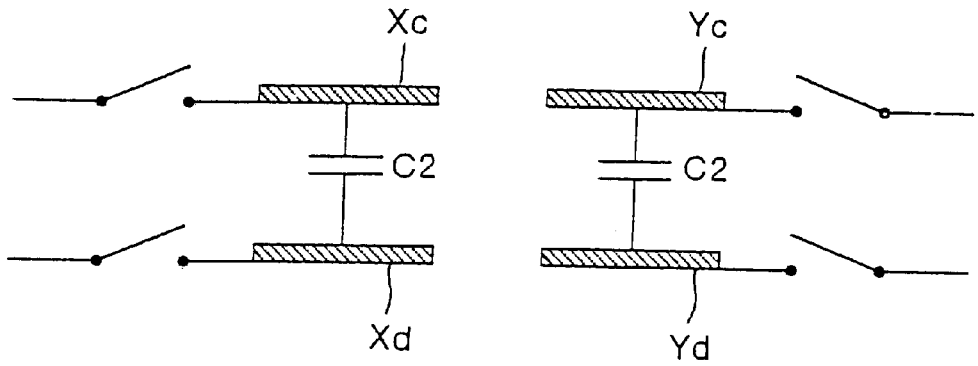
FIG. 14 shows an equivalent circuit of Example 4 of the present invention.

FIG. 14 shows an equivalent circuit in accordance with Example 4. A voltage-raising capacity $C_2$ is formed of the dielectric layer between the discharge electrodes Xc and Yc and the drive electrodes Xd and Yd. In this circuit, first, a voltage is applied to the discharge electrode Xc to store a charge in the voltage-raising capacity $C_2$ of the dielectric layer between the discharge electrode Xc and drive electrode Xd. That is, the voltage-raising capacity $C_2$ is charged. Thereafter, a voltage is applied to the drive electrode Xd to generate discharge across the discharge electrodes Xc and Yc (actually, surface discharge is generated on the protecting film 18 formed on the dielectric layer 17). Subsequently, a voltage is applied to the discharge electrode Yc, and discharge is generated in the opposite direction by applying a voltage in similar order.

When a voltage is applied to the discharge electrode Xc to charge the voltage-raising capacity $C_2$ between the discharge electrode Xc and the drive electrode Xd, a voltage of reverse potential may be applied to the discharge electrode Yc to store a charge of reverse potential at the voltage-raising capacity $C_2$ between the discharge electrode Yc and the drive electrode Yd. In this case, the discharge voltage can further be raised.

EXAMPLE 5

Figure 15:
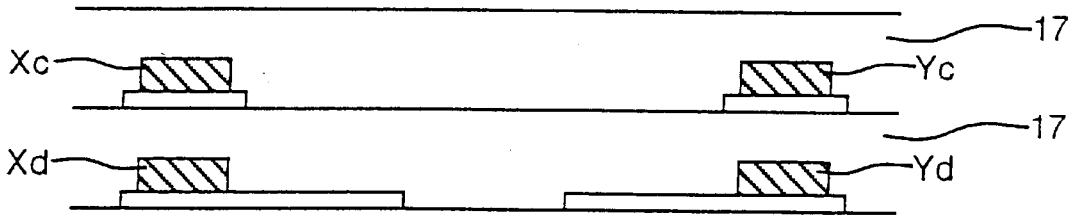
FIG. 15 is a schematic view illustrating a PDP in accordance with Example 5 of the present invention.

FIG. 15 is a schematic view illustrating a PDP in accordance with Example 5. The discharge electrodes Xc and Yc need not necessarily have the same shape as the drive electrode Xd and Yd. For example, as shown in FIG. 15, the discharge electrodes Xc and Yc may have a smaller width.

Figure 16:
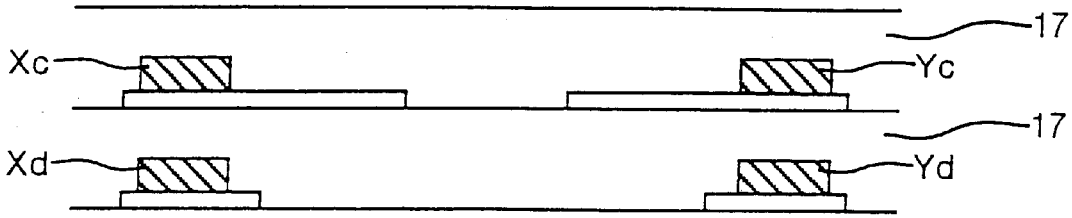
FIG. 16 is a schematic view illustrating a modified PDP in accordance with Example 5 of the present invention.

FIG. 16 is a schematic view illustrating a modified example of Example 5. The drive electrodes Xd and Yd may have a smaller width, for example, as shown in FIG. 16. In this case, the voltage-raising capacity $C_2$ varies depending upon the size of the drive electrodes Xd and Yd. Therefore, the width of the drive electrodes Xd and Yd is set as appropriate. If the width of the drive electrodes Xd and Yd is decreased, the voltage-raising capacity $C_2$ decreases. Accordingly, the time necessary for charging the voltage-raising capacity $C_2$ can be shortened.

Furthermore, either the drive or discharge electrodes may be formed only of metal electrodes. In this case, transparent electrodes need not be formed, which facilitates the production of the PDP advantageously.

EXAMPLE 6

Figure 17:
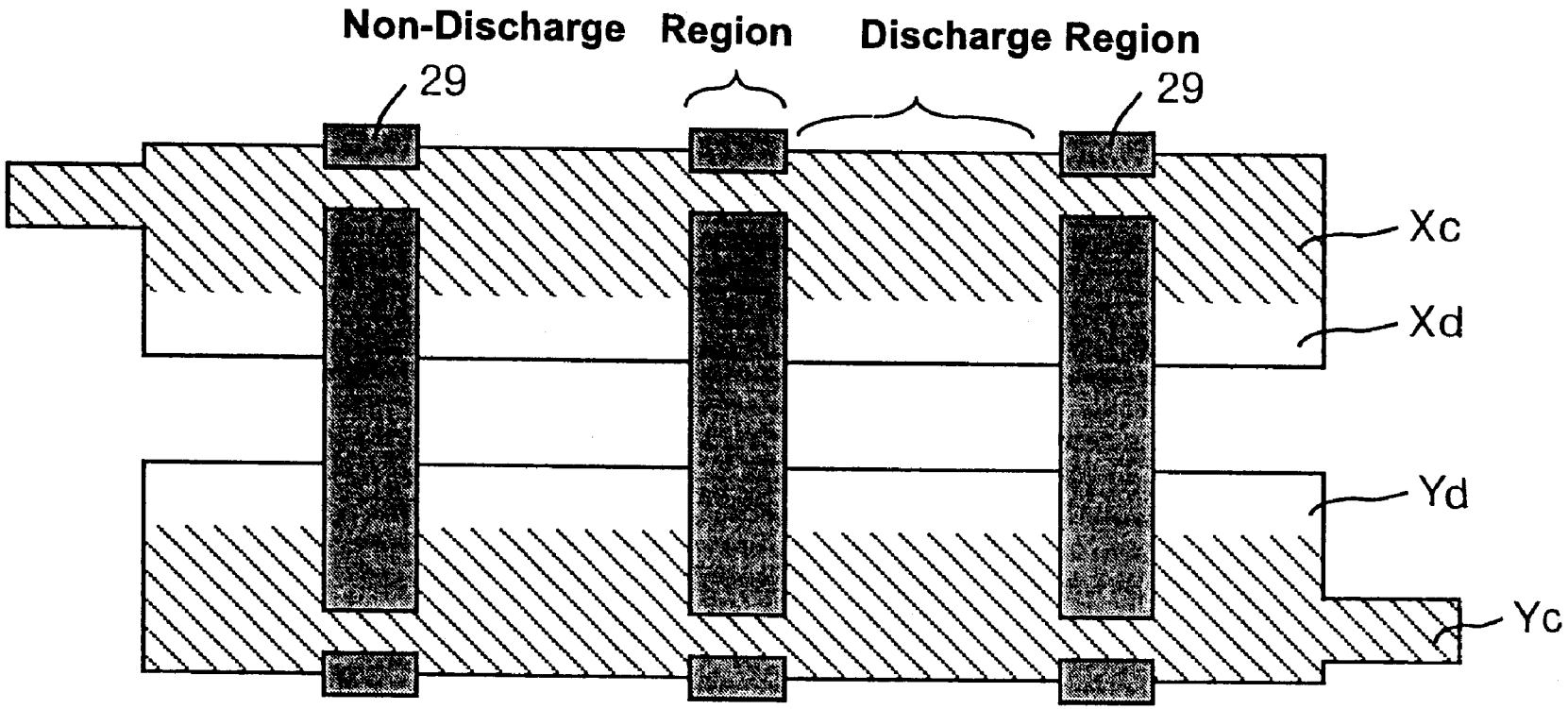
FIG. 17 is a schematic view illustrating a PDP in accordance with Example 6 of the present invention.

FIG. 17 is a schematic view illustrating a PDP in accordance with Example 6. In the figure, shaded portions represent an overlap of the discharge electrode Xc and the drive electrode Xd in plan view and an overlap of the discharge electrode Yc and the drive electrode Yd in plan view.

The discharge electrodes Xc and Yc and the drive electrodes Xd and Yd need not necessarily be arranged at uniform intervals or with uniform overlaps. For example, as shown in FIG. 17, they overlap in a larger area in a discharge region and in a smaller area in a non-discharge region (a region of a barrier rib 29).

Figure 18:
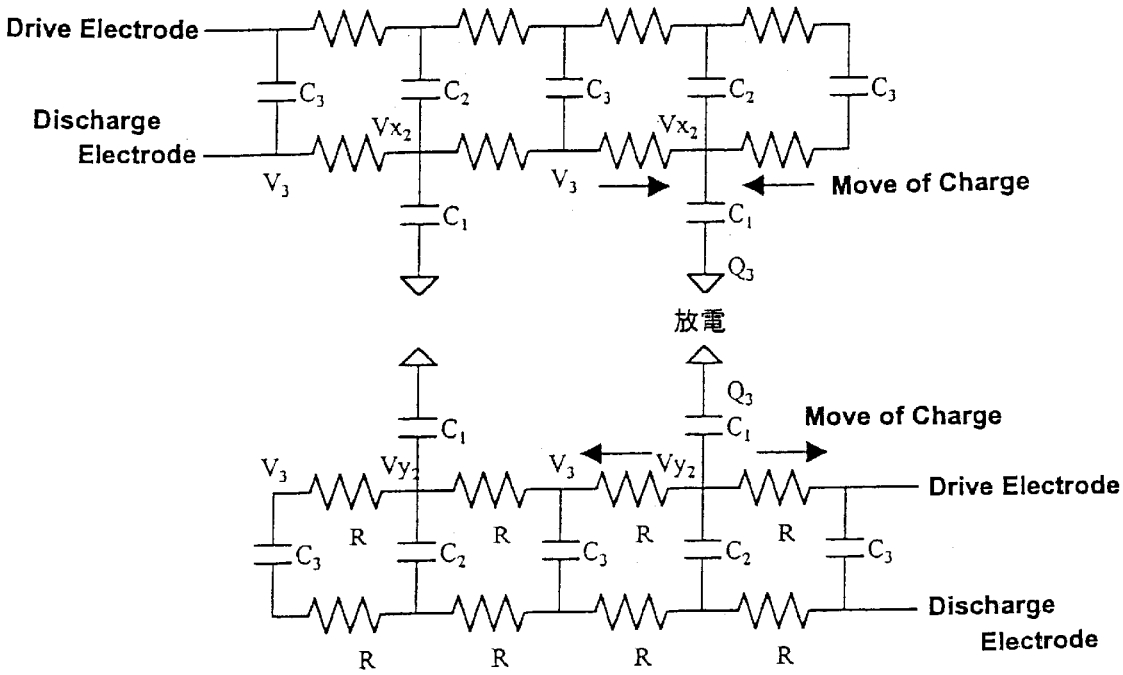
FIG. 18 shows an equivalent circuit of Example 6 of the present invention.

FIG. 18 shows an equivalent circuit of this Example 6. In the case where overlaps in the discharge region and in the non-discharge region are the same, potentials $Vx_2$ and $Vy_2$ on the discharge electrodes Xc and Yc in the discharge region are changed by a wall charge $Q_3$ formed on the surface of the dielectric layer and differ from a potential $V_3$ in the non-discharge region, which results in a move of a charge between the discharge region and the non-discharge region. However, if the area of the overlap in the discharge region is increased to enlarge the voltage-raising capacity $C_2$ in the discharge region, the difference in the potentials in the discharge region and in the non-discharge region can be decreased and the move of a charge can be reduced.

EXAMPLE 7

Figure 19:
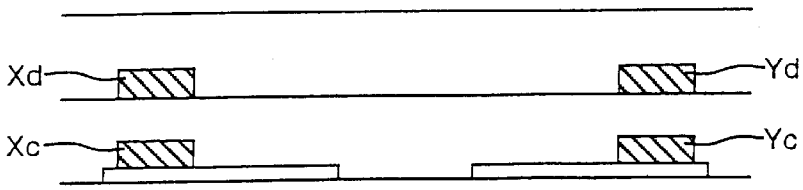
FIG. 19 is a schematic view illustrating a PDP in accordance with Example 7 of the present invention.

FIG. 19 is a schematic view illustrating a PDP in accordance with Example 7. In this example, the drive electrodes are elongated and the discharge electrode Xc and Yc are disposed in a lower electrode.

Also, in this case, the voltage-raising capacity $C_2$ is formed between the discharge electrodes Xc and Yc and the drive electrodes Xd and Yd. In this circuit, first, a voltage is applied to the discharge electrode Xc and Yc (alternatively, the voltage may be applied to either one of the discharge electrodes, as mentioned above) to charge the voltage-raising capacity in the dielectric layer between the discharge electrodes Xc and Yc and the drive electrodes Xd and Yd. Subsequently, a voltage is applied to the drive electrodes Xd and Yd to generate discharge across the discharge electrodes Xc and Yc. Actually, a surface discharge occurs on the protecting film 18 formed on the dielectric layer 17, but the drive electrodes Xd and Yd do not disturb the discharge. With this construction, the drive electrodes Xd and Yd need not be formed of transparent electrodes advantageously.

EXAMPLE 8

Figure 20:
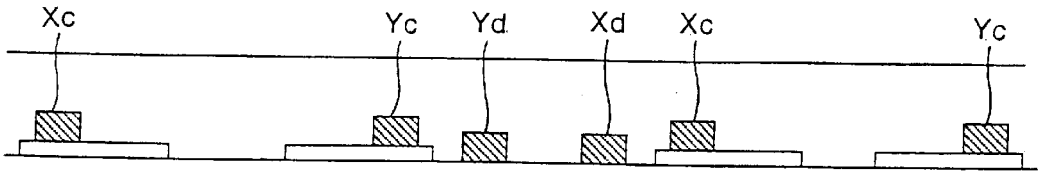
FIG. 20 is a schematic view illustrating a PDP in accordance with Example 8 of the present invention.

FIG. 20 is a schematic view illustrating a PDP in accordance with Example 8. In this example, as shown in the figure, the drive electrodes Xd and Yd and the discharge electrodes Xc and Yc are formed on the same plane. In this circuit, a voltage is applied to the discharge electrodes Xc and Yc (alternatively, the voltage may be applied to either one of the discharge electrodes as mentioned above) to store the voltage-raising capacity in the dielectric layer between the discharge electrodes Xc and Yc and the drive electrodes Xd and Yd. Thereafter, a voltage is applied to the drive electrodes Xd and Yd to generate discharge across the discharge electrodes Xc and Yc.

The capacitance of the voltage-raising capacity varies depending upon the distance between the discharge electrode Yc and the drive electrode Yd and the distance between the discharge electrode Xc and the drive electrode Xd. These distances need to be set as appropriate. This construction is advantageous from the viewpoint of simple production since it is unnecessary to form electrodes on the dielectric layer.

EXAMPLE 9

Figure 21:
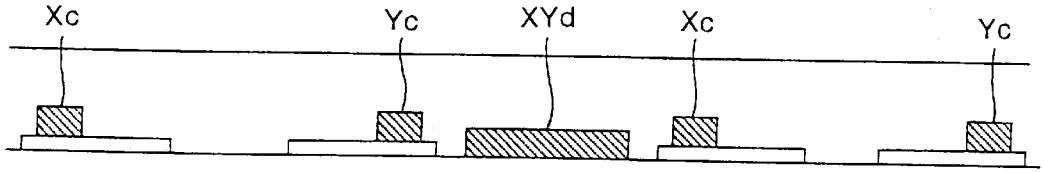
FIG. 21 is a schematic view illustrating a PDP in accordance with Example 9 of the present invention.
Figure 22:
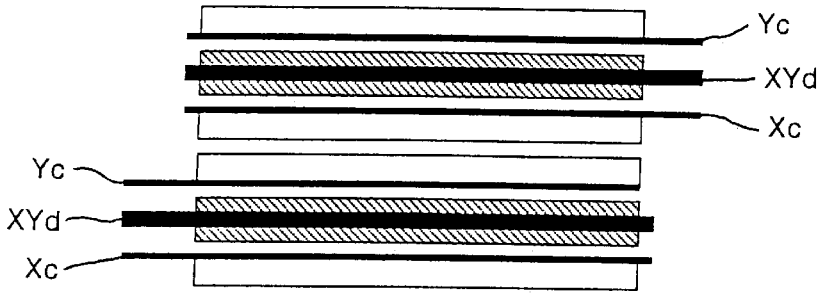
FIG. 22 is a plan view of the PDP of FIG. 21.

FIG. 21 and FIG. 22 are schematic views illustrating a PDP in accordance with Example 9. FIG. 22 is a plan view of FIG. 21. In Example 8, the drive electrodes Xd and Yd are formed for the respective discharge electrodes Xc and Xc, but in this example, adjacent drive electrodes are combined to form a common drive electrode. More particularly, one drive electrode for the discharge electrodes Xc and Yc and one drive electrode for adjacent discharge electrodes Xc and Yc are combined to form a common drive electrode XYd for driving them in phase.

This construction is advantageous since the number of drive electrodes is reduced to half. Also the common drive electrode in this case functions as a light shielding element in a non-light-emitting region (a so-called reverse slit) and consequently improves the contrast of display.

EXAMPLE 10

Figure 23:
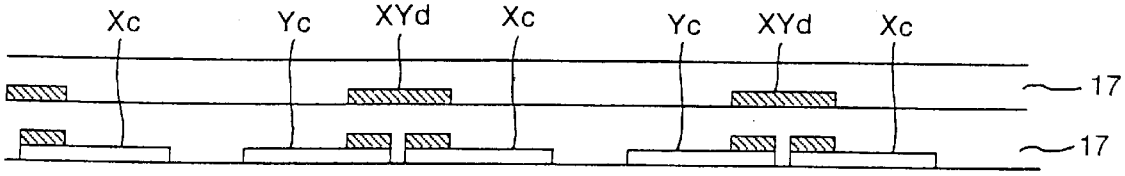
FIG. 23 is a schematic view illustrating a PDP in accordance with Example 10 of the present invention.

FIG. 23 is a schematic view illustrating a PDP in accordance with Example 10. In this example, the common drive electrode XYd of Example 9 is disposed in an upper layer with intervention of the dielectric layer. This construction is advantageous in that a light emitting region can be increased.

EXAMPLE 11

Figure 24:
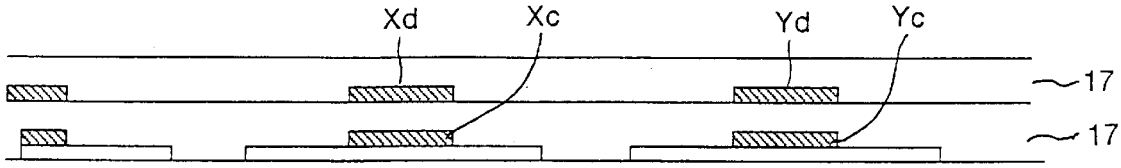
FIG. 24 is a schematic view illustrating a PDP in accordance with Example 11 of the present invention.

FIG. 24 is a schematic view illustrating a PDP in accordance with Example 11, in which the present invention is applied to a panel of an ALiS (alternate lighting of surfaces) structure. In the panel of this ALiS structure, discharge electrodes X and Y are equidistantly arranged, and interlace driving is carried out to light cells in odd-numbered lines in odd-numbered field and cells in even-numbered lines in even numbered field. Accordingly, the discharge electrodes Xc and Yc and the drive electrodes Xd and Yd are also arranged equidistantly.

EXAMPLE 12

Figure 25A:
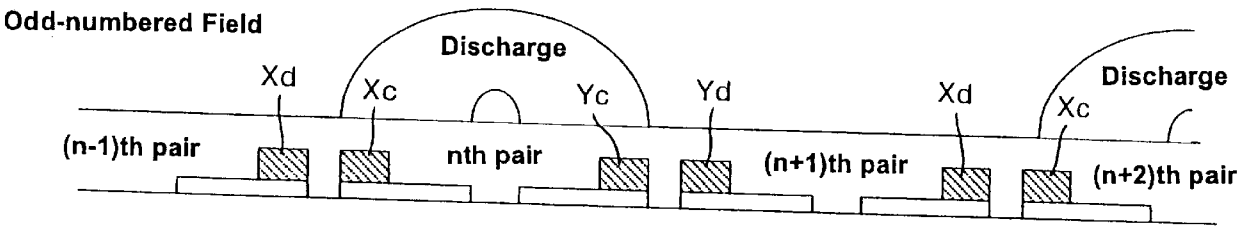
FIGS. 25A and 25B are schematic views illustrating a PDP in accordance with Example 12 of the present invention.
Figure 25B:
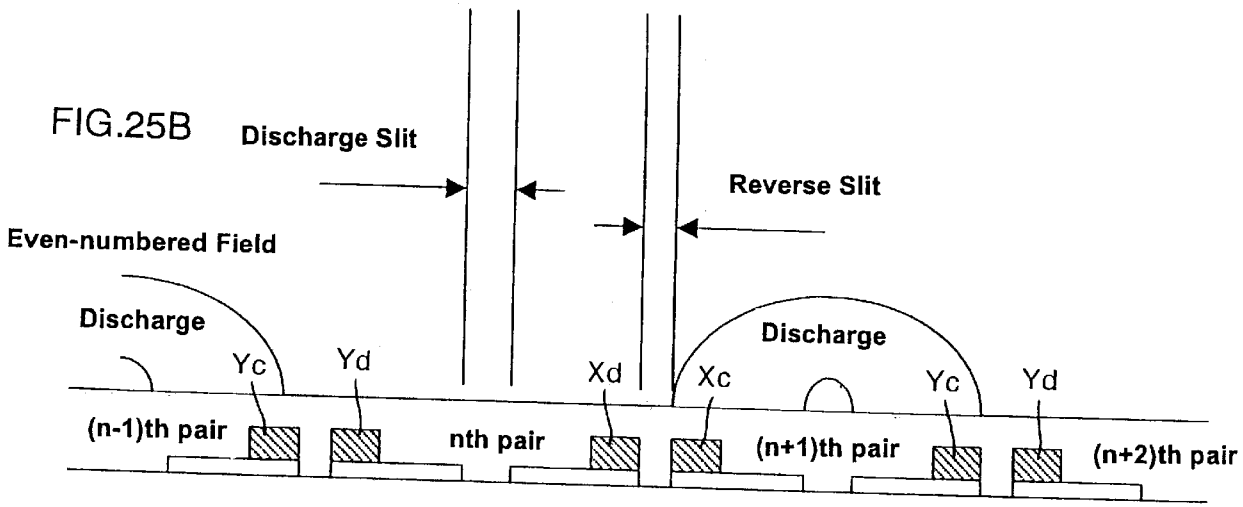

FIGS. 25A and 25B are schematic views illustrating a PDP in accordance with Example 12. FIG. 25A shows a state of discharge in an odd-numbered field, and FIG. 25B shows a state of discharge in an even-numbered field. In this PDP, the shape of the discharge electrodes Xc and Yc is the same as that of the display electrodes X and Y of the typical panel shown in FIG. 44, but the discharge electrodes Xc and Yc are arranged at smaller intervals with reverse slits smaller than in the typical panel.

In this example, the function of the drive electrodes Xd and Yd and the function of the discharge electrodes Xc and Yc are changed between the odd-numbered fields and the even-numbered fields. In this driving method, the capacity between the reverse slits is used as voltage-raising capacity.

EXAMPLE 13

Figure 26:
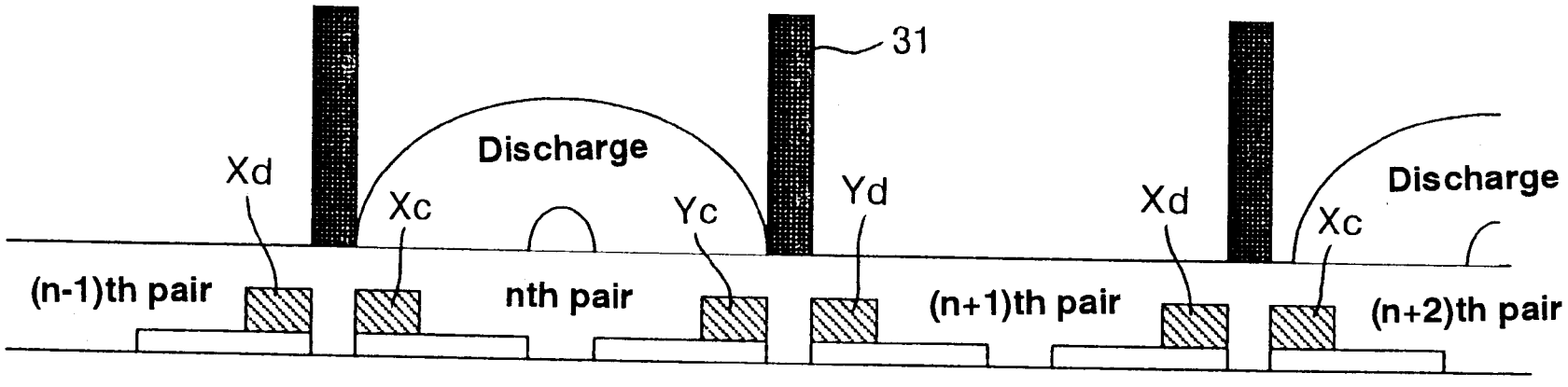
FIG. 26 is a schematic view illustrating a PDP in accordance with Example 13 of the present invention.

FIG. 26 is a schematic view illustrating a PDP in accordance with Example 13. In this example, a barrier wall 31 is provided at the reverse slit in the PDP of Example 12. If discharge at the reverse slit is a problem in Example 12, the barrier wall 31 may be mounted as in this example.

EXAMPLE 14

Figure 27:
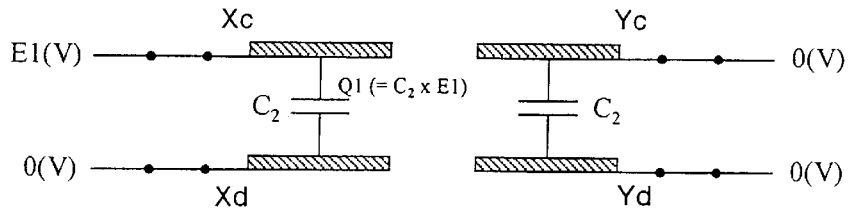
FIG. 27 illustrates a voltage-raising capacity charging process in a driving method in accordance with Example 14 of the present invention.
Figure 28:
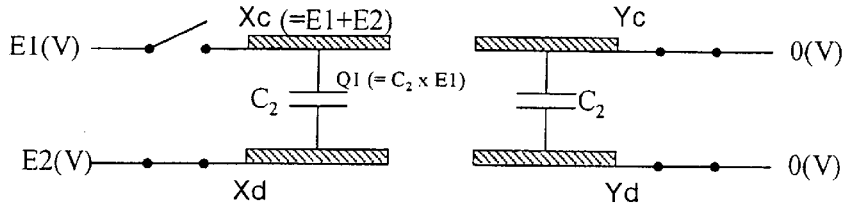
FIG. 28 illustrates a discharge process in the driving method of Example 14 of the present invention.
Figure 29:
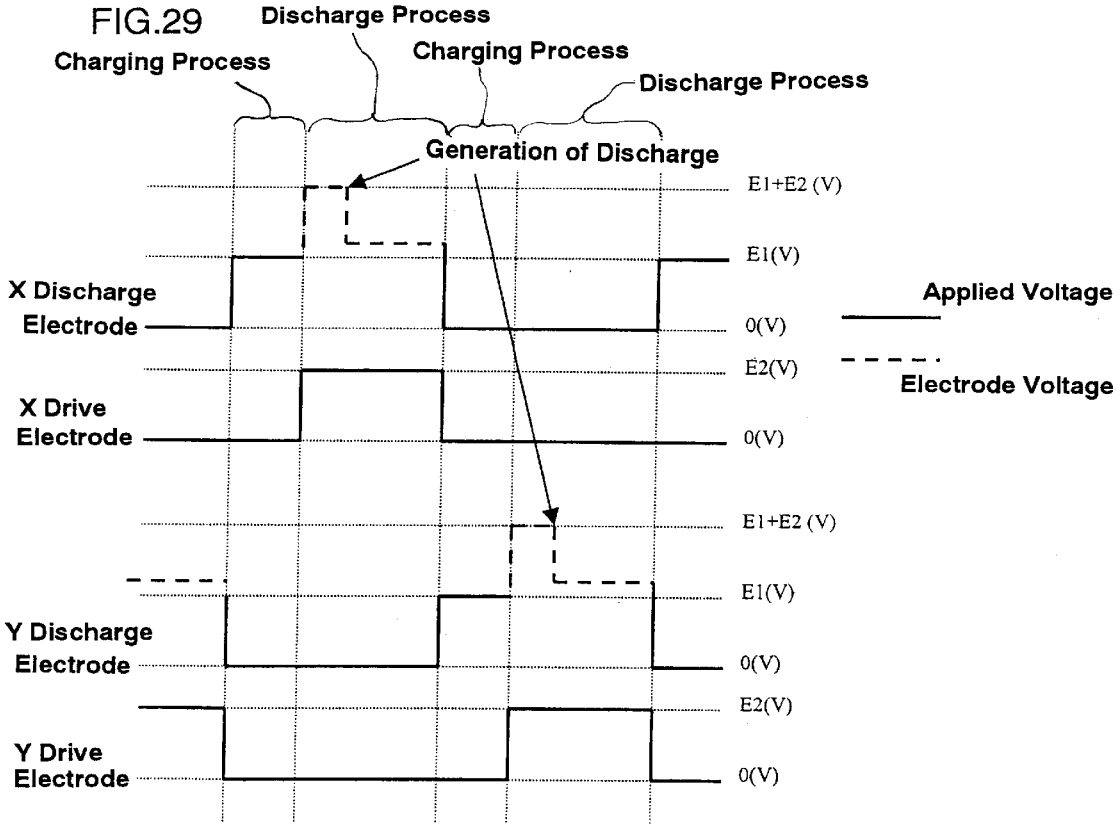
FIG. 29 is a graphical representation of changes in voltage in the driving method of Example 14 of the present invention in which the voltage-raising capacity charging process is provided at positive electrodes.

FIG. 27, FIG. 28 and FIG. 29 illustrate timing of applying voltage in accordance with Example 14. In this example, the process of applying voltage can be divided into a voltage-raising capacity charging process and a discharge process. In the voltage-raising capacity charging process, voltage is applied to the discharge electrodes to charge the voltage-raising capacity. In the discharge process, the discharge electrodes are electrically floated and voltage is applied to the drive electrode Xd to generate discharge.

In this example, as an example of timing of applying voltage, the voltage-raising capacity charging process is set only for either a group of X electrodes or a group of Y electrodes, which serve as positive electrodes. FIG. 27 illustrates the voltage- raising capacitor charging process in this driving method, FIG. 28 illustrates the discharge process in this driving method, and FIG. 28 is a graph showing changes in voltage in this driving method.

EXAMPLE 15

Figure 30:
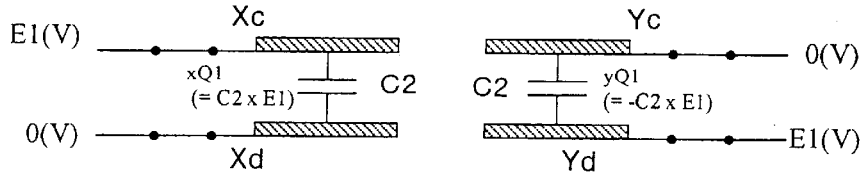
FIG. 30 illustrates a voltage-raising capacity charging process in a driving method in accordance with Example 15 of the present invention.
Figure 31:
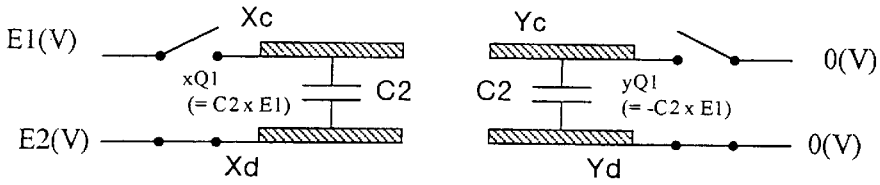
FIG. 31 illustrates a discharge process in the driving method of Example 15 of the present invention.
Figure 32:
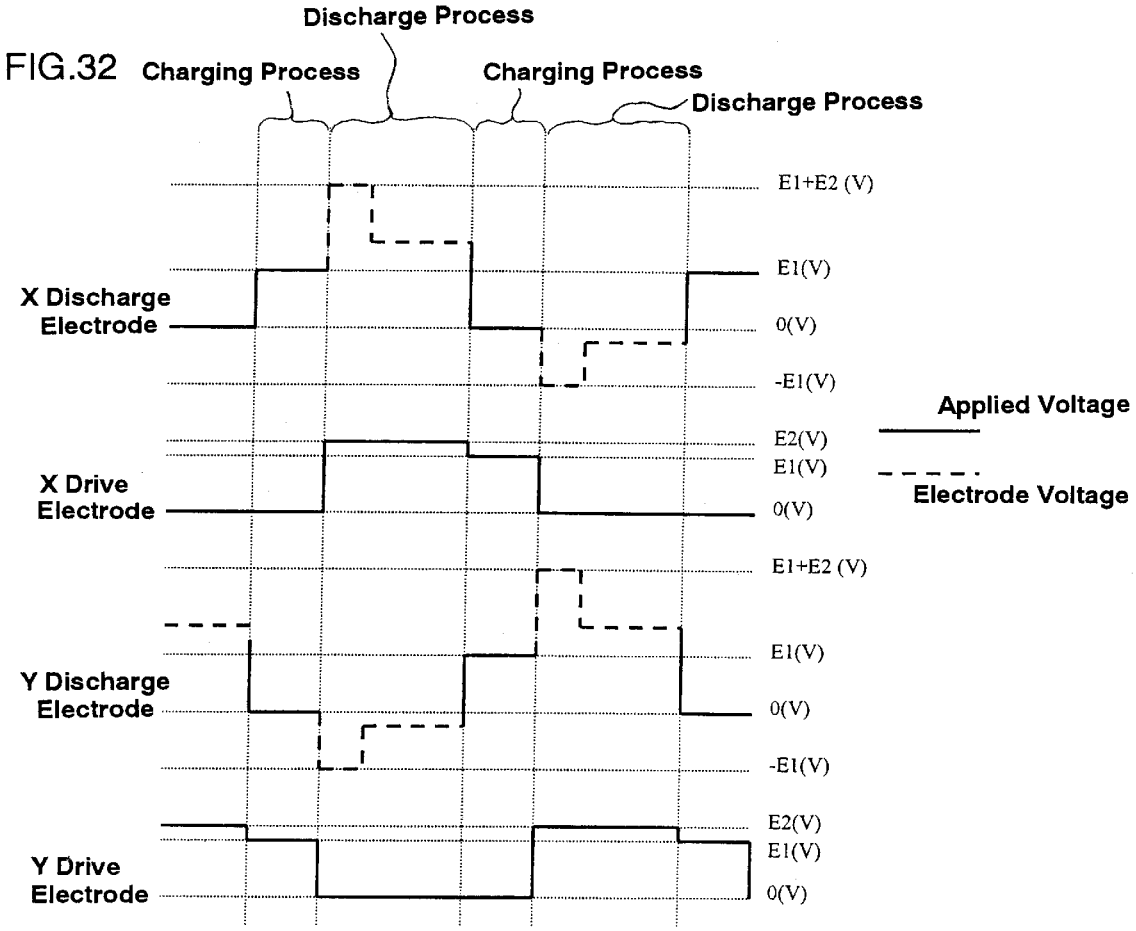
FIG. 32 is a graphical representation of changes in voltage in the driving method of Example 15 of the present invention in which the voltage-raising capacity charging process is provided at positive and negative electrodes.

FIG. 30, FIG. 31 and FIG. 32 illustrate timing of applying voltage in accordance with Example 15. In this example, the voltage-raising capacity charging process is set for both positive and negative electrodes. In a group of electrodes which serve as negative electrodes, E1 (V) and 0 V are applied to the drive electrodes and the discharge electrodes, respectively, to store a charge $Q1=-C_2\times E1$ on a discharge electrode side in the voltage-raising capacity charging period. Thereby, in the discharge period, the potential of the drive electrodes is 0 V and the potential of the discharge electrodes is −E1 (V) when the discharge electrodes are floated. Thus, in the case where the voltage-raising capacity charging process is set for both positive and negative electrodes, an effective drive voltage becomes $2\times E1+E2$. FIG. 30 and FIG. 31 are schematic views illustrating the voltage-raising capacity charging process and the discharge process, respectively, according to the driving method of this example. FIG. 32 is a graphical representation of changes of voltage in this driving method.

EXAMPLE 16

Figure 33:
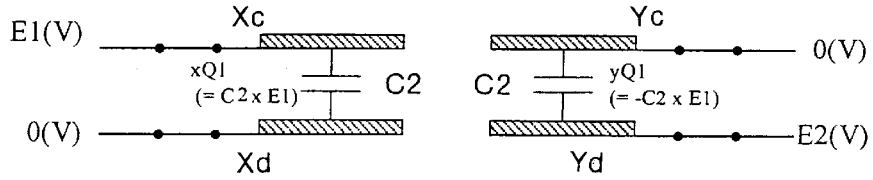
FIG. 33 illustrates a voltage-raising capacity charging process in a driving method in accordance with Example 16 of the present invention.
Figure 34:
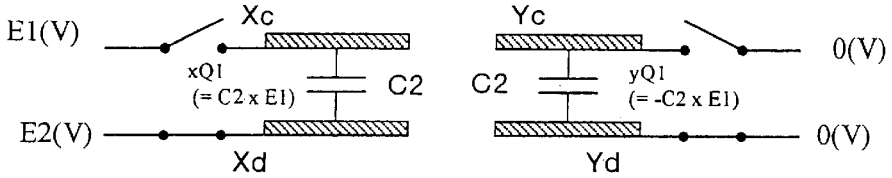
FIG. 34 illustrates a discharge process in the driving method of Example 16 of the present invention.
Figure 35:
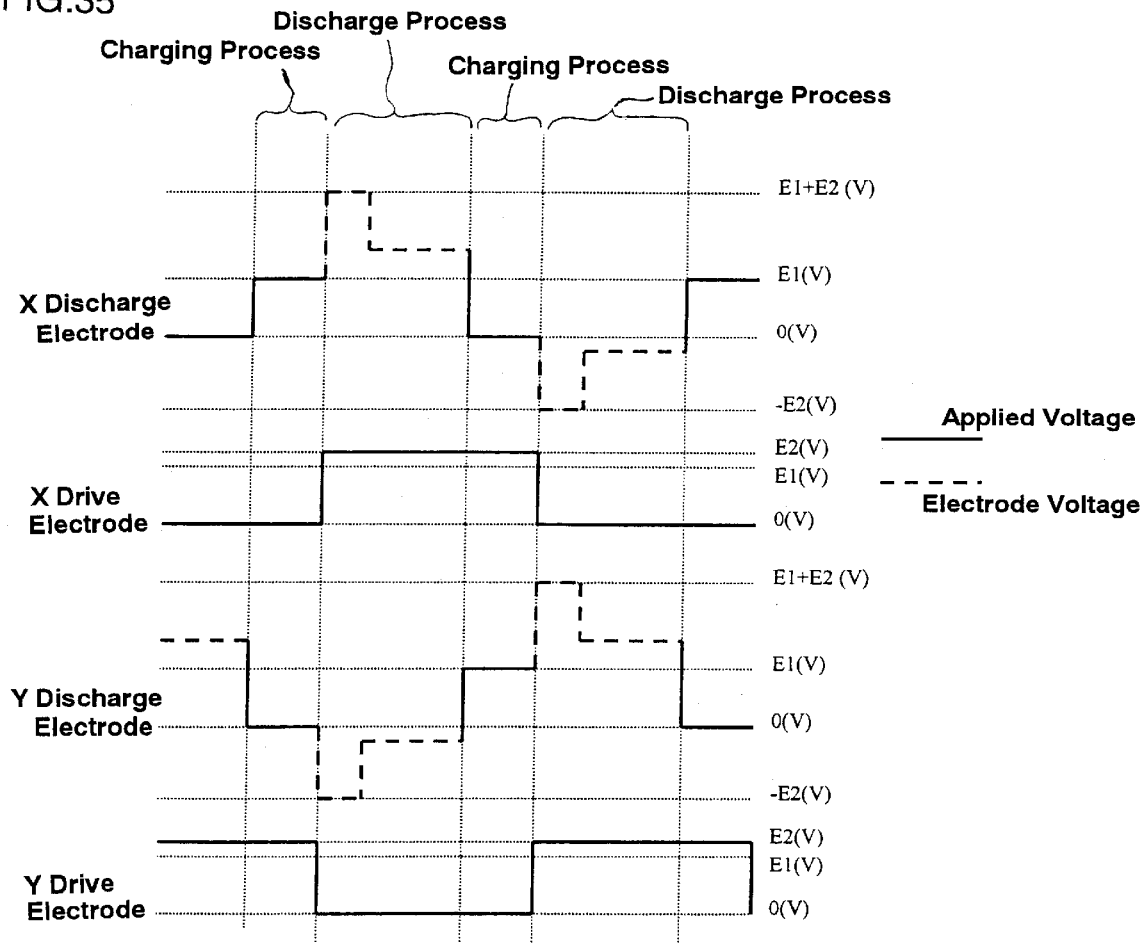
FIG. 35 is a graphical representation of changes in voltage in the driving method of Example 16 of the present invention in which the voltage applied to drive electrodes has two values.

FIG. 33, FIG. 34 and FIG. 35 illustrate timing of applying voltage in accordance with Example 16. In this example, the voltage applied to the drive electrodes has two values for the intention of reducing the size of the drive circuit of Example 15 in which the voltage applied to the drive electrodes is trinary (i.e., 0, E1, E2).

In this example, in the group of electrodes which serve as negative electrodes, E2 (V) and 0 V are applied to the drive electrodes and the discharge electrodes, respectively, to store a charge $Q2=-C_2\times E2$ on the discharge electrode side in the voltage-raising capacity charging period. Thereby, in the discharge period, the potential of the drive electrodes is 0 V and the potential of the discharge electrodes is −E2 (V) when the discharge electrodes are floated. Thus, the effective drive voltage becomes $E1+2\times E2$. FIG. 33 and FIG. 34 are schematic views illustrating the voltage-raising capacity charging process and the discharge process, respectively, according to the driving method of this example. FIG. 35 is a graphical representation of changes of voltage in this driving method.

EXAMPLE 17

Figure 36:
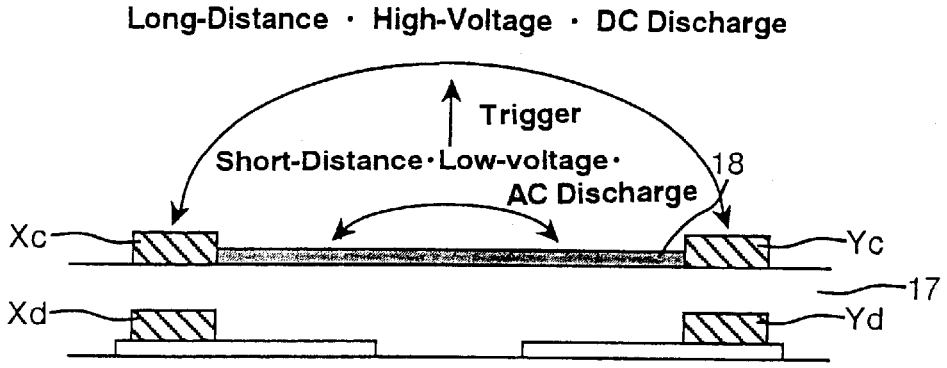
FIG. 36 is a schematic view illustrating a PDP in accordance with Example 17 of the present invention.

FIG. 36 is a schematic view illustrating a PDP in accordance with Example 17. In this example, there is not provided a dielectric layer on the electrodes in the upper layer. In cases where the discharge electrodes and the drive electrodes are in layers as in Examples 4, 5, 6, 7, 10 and 11, the dielectric layer on the electrodes in the upper layer may be omitted.

In the PDP of this example, the drive electrodes Xd and Yd, the dielectric layer 17 and the discharge electrodes Xc and Yc are sequentially formed on the glass substrate. The discharge electrodes Xc and Yc are formed only of metal electrodes.

In this structure, the distance between the discharge electrodes Xc and Yc are large and consequently a higher discharge initiating voltage is required. However, since the voltage of the discharge electrodes Xc and Yc are raised by the voltage-raising capacity, the effective voltage applied becomes higher. Therefore, the discharge initiating voltage can be reached without raising the drive voltage. Also, a charge flows out into the voltage-raising capacity by the generation of discharge, and as a result, the discharge spontaneously terminates.

The drive electrodes Xd and Yd have the same structure as the display electrodes of the typical AC driven PDP and have a memory property. The discharge initiating voltage across the discharge electrodes Xc and Yc is decreased by an increase in priming particles when discharge takes place across the drive electrodes Xd and Yd. Thus, an AC-driven discharge across the drive electrodes Xd and Yd is utilized as a trigger for a DC discharge across the discharge electrodes Xc and Yc.

EXAMPLE 18

Figure 37:
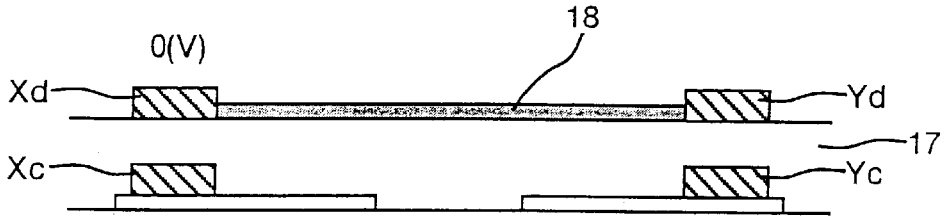
FIG. 37 is a schematic view illustrating a PDP in accordance with Example 18 of the present invention.

FIG. 37 is a schematic view illustrating a PDP in accordance with Example 18. Also in this example, the dielectric layer on the electrodes in the upper layer is omitted. In the PDP of this example, the discharge electrodes Xc and Yc, the dielectric layer 17 and the drive electrodes Xd and Yd are sequentially formed on the glass substrate. The drive electrodes Xd and Yd are formed only of metal electrodes.

In this structure, the drive electrodes are not provided with a high voltage and therefore do not relate to discharge. However, this example has the following advantages.

Production is easy because the dielectric layer need not be formed on the upper layer. Further, an absolute potential of the discharge space can be fixed because the electrodes are exposed in the discharge space. Therefore, it is possible to suppress in-planar ununiformity in potential in the panel owing to charge transfer or the like.

Figure 38:
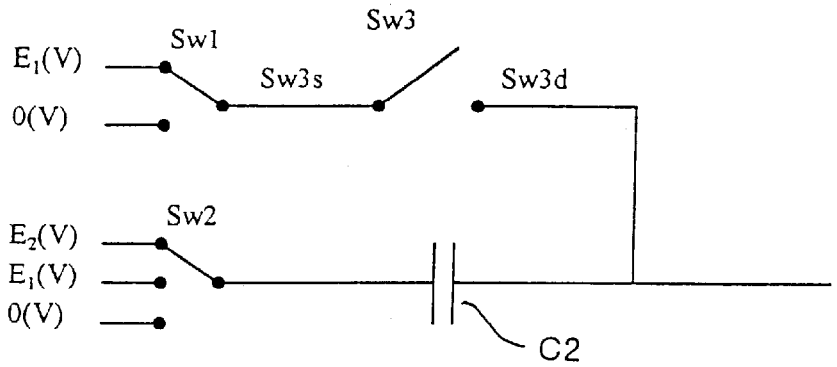
FIG. 38 illustrates an example of a drive circuit in accordance with the present invention.

Next, FIG. 38 illustrates an example of a drive circuit common to all the examples described above. As shown in this figure, the drive circuit includes a switch Sw1 for applying voltage to the discharge electrodes, a switch Sw2 for applying voltage to the drive electrodes and a switch Sw3 for electrically separating the discharge electrodes.

Since the switch Sw1 receives two values of voltage, i.e., 0 (V) and $E_1$ (V), the withstand voltage of the switch Sw1 is $E_1$ (V). The switch Sw2 receives three values of voltage, i.e., 0 (V), $E_1$ (V) and $E_2$ (V), and therefore, the withstand voltage of the switch Sw2 is the higher one of $E_1$ (V) and $E_2$ (V).

A power supply side (Sw3s) of the switch Sw3 receives three values of voltage, i.e., 0 (V), $E_1$ (V) and $E_2$ (V) and an electrode side (Sw3d) thereof receives $-E_1$ (V), 0 (V), $E_1$ (V) and $E_1+E_2$ (V). Therefore, the switch Sw3 needs to have a withstand voltage of $E_1+E_2$ (V). If $E_1=E_2-E/3$ (E is a present drive voltage) as mentioned above, the withstand voltage needs to be 2E/3 (V).

FIGS. 39A to 39D and FIGS. 40A to 40D illustrate driving methods for lowering the withstand voltage of switch elements. FIGS. 39A to 39D illustrates states of a circuit when a charging side electrode is positive. FIG. 39A shows the state of charging the voltage-raising capacity, FIG. 39B shows the state during discharge, FIG. 39C shows the state after discharge and FIG. 39D shows the state of falling.

Figure 40A:
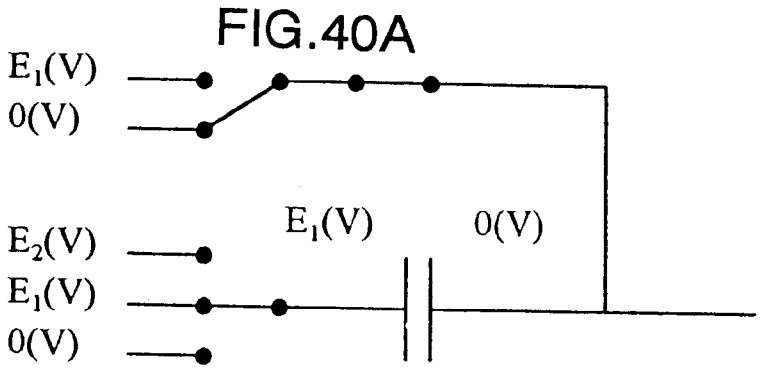
FIGS. 40A to 40D illustrate a driving method in accordance with the present invention in which the voltage of a switch element of the drive circuit is reduced.
Figure 40B:
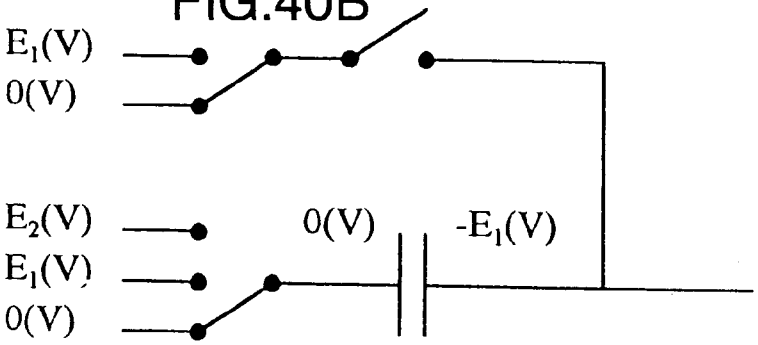
Figure 40C:
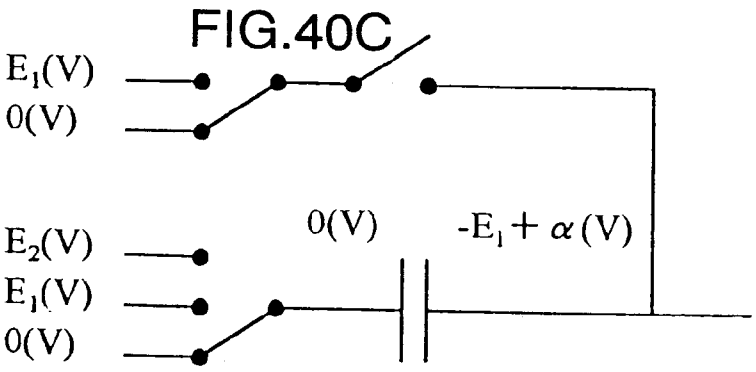
Figure 40D:
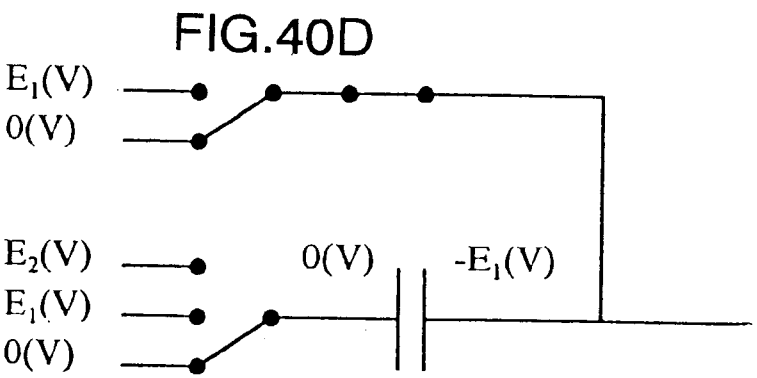

FIGS. 40A to 40D illustrates states of the circuit when a charging side electrode is negative. FIG. 40A shows the state of charging the voltage-raising capacity, FIG. 40B shows the state during discharge, FIG. 39A shows the state after discharge and FIG. 40D shows the state of falling.

If the electrode is on the positive side, it is possible to apply $E_2$ (V), $E_2-\alpha$ (V) and $E_2-\alpha$ (V) to Sw3 during discharge (see FIG. 39B), after discharge (see FIG. 39C) and at falling (see FIG. 39D) by fixing the power supply side of the switch Sw3 at $E_1$ (V).

Here, a represents a drop in the voltage of the discharge electrodes as described above and is $(E_1+E_2)/2$ at the largest. If $E2 \geqq E1 > 3$, the withstand voltage of the switch Sw3 may be the higher one of $E_1$ (V) and $E_2$ (V).

Similarly, in the case where the electrode is on the negative side, the withstand voltage of the switch Sw3 can be lowered by applying 0 (V) to the power supply side of the switch Sw3.

Figure 41:
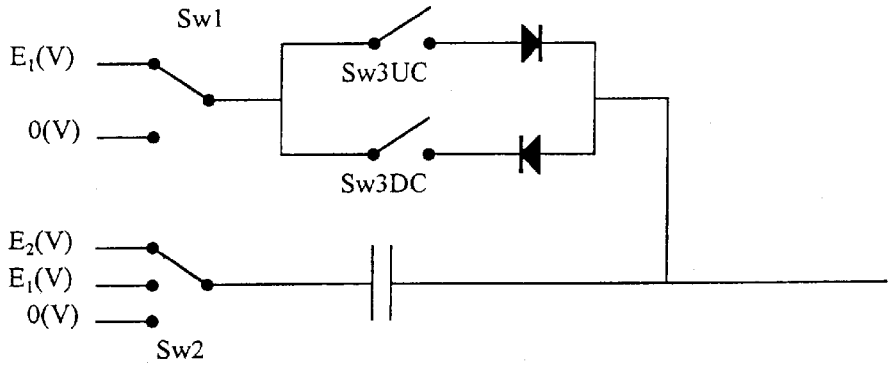
FIG. 41 illustrates a modified example of a switch Sw3 of the drive circuit in accordance with the present invention.

FIG. 41, illustrates a modified example of the switch Sw3.

Figure 42:
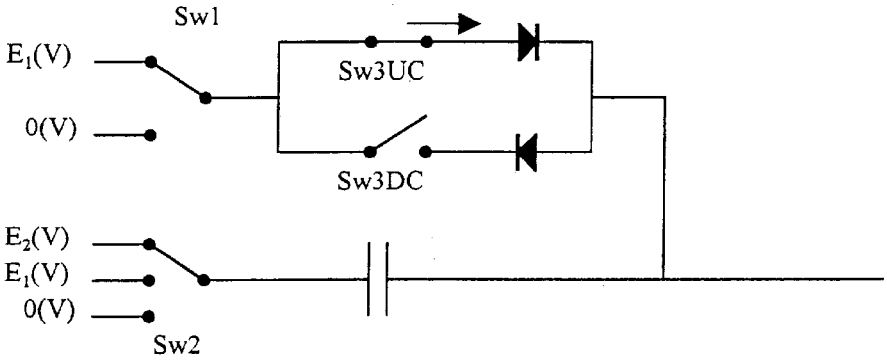
FIG. 42 illustrates a state of switch Sw3 of FIG. 41 when it is on a positive side.
Figure 43:
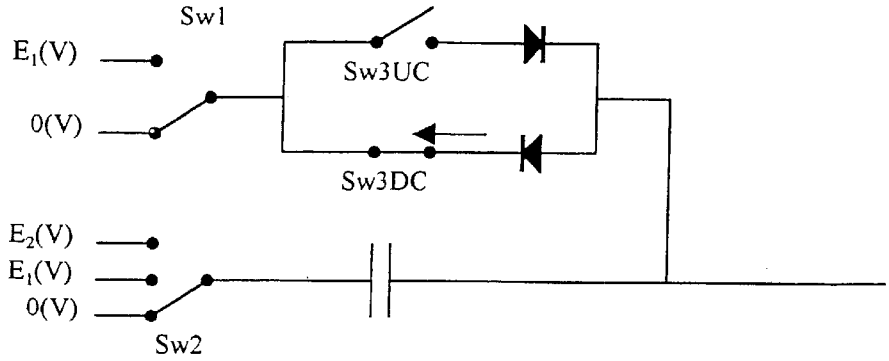
FIG. 43 illustrates a state of switch Sw3 of FIG. 41 when it is on a negative side.

FIG. 42 illustrates the state of the switch Sw3 of FIG. 41 when it is on a positive side. FIG. 43 illustrates the state of the switch Sw3 of FIG. 41 which it is on a negative side.

The switch Sw3 of the drive circuit may be composed of two switches, i.e., a switch Sw3UC in a direction of electric current flowing into the electrode and a switch Sw3DC in a direction of electric current flowing out of the electrode. When the electrode is on the positive side, the switch Sw3UC may be turned on and the switch Sw3DC may turned off at discharge. When the electrode is on the negative side, the switch Sw3DC may be turned on and the switch Sw3UC may be turned off at discharge.

By thus driving the two switches separately and controlling the switches Sw3UC and Sw3Dc at discharge, the electrode is floated when the voltage of the discharge electrode is E1 or higher, and electric current flows in and the voltage of the electrode is fixed to E1 when the voltage of the discharge electrode becomes E1 or lower owing to the discharge. This driving realizes $0 \leqq \alpha \leqq (E1+E2)/2$. Therefore, it is possible to avoid the problem about the settings of the voltage E2 and E1.

According to the present invention, the provision of the voltage-raising capacity element allows discharge to be generated by voltage lower than the conventionally established voltage. Therefore, load on the drive circuit can be reduced, the power consumption can be decreased and the production costs of the drive circuit can be reduced.

What is claimed is:

1. A plasma display panel comprising:

at least one pair of discharge electrodes disposed on a substrate;

a drive circuit applying a discharge voltage to the discharge electrodes;

capacity elements raising voltage connected in series between the discharge electrodes and the drive circuit; and a control circuit generating discharge across the discharge electrodes, the control circuit applying a charging voltage to the capacity elements raising voltage and thereafter applying the discharge voltage from the drive circuit to the discharge electrodes via the capacity elements raising voltage, thereby reducing power consumption by reducing a drive circuit voltage while maintaining a discharge electrode voltage.

2. A plasma display panel according to claim 1 further comprising:

drive electrodes disposed with intervention of a dielectric layer between the discharge electrodes and the drive electrodes, wherein the capacity elements raising voltage are formed of the dielectric layer, and the control circuit, generating discharge across the discharge electrodes, applies the charging voltage to the discharge electrodes and thereafter applies the discharge voltage from the drive circuit to the drive electrodes.

3. A plasma display panel according to claim 2, wherein the drive electrodes are arranged to overlap with the discharge electrodes.

4. A plasma display panel according to claim 2, wherein the drive electrodes and the discharge electrodes are in the same plane.

5. A plasma display panel according to claim 4, wherein the drive electrodes and the discharge electrodes change their functions with each other alternately at every discharge.

6. A plasma display panel according to claim 2, wherein the drive electrodes form one drive electrode which is used commonly to a plurality of adjacent discharge electrodes.

7. A method of driving a plasma display panel to reduce power consumption, comprising:

applying a scan pulse to a plurality of cells in the plasma display panel to select a cell to be lit;

applying a sustain pulse to the plurality of cells to sustain the lighting of the selected cell;

applying a charge voltage to a plurality of capacity elements to raise the voltage between a plurality of discharge electrodes and a drive circuit;

applying a discharge voltage from the drive circuit to the plurality of discharge electrodes via the plurality of capacity elements to raise the voltage of the discharge electrodes and to generate discharge across the discharge electrodes;

adding the charge voltage to the discharge voltage; and applying the sum of the charge voltage and the discharge voltage to the plurality of discharge electrodes, thereby maintaining the voltage of the discharge electrodes while reducing the voltage of the drive circuit.

* * * * *